US008348407B2

(12) United States Patent
Matsufuji et al.

(10) Patent No.: US 8,348,407 B2
(45) Date of Patent: Jan. 8, 2013

(54) LIQUID EJECTION HEAD, LIQUID-DROPLET EJECTION DEVICE, AND IMAGE FORMING APPARATUS

(75) Inventors: Ryouta Matsufuji, Isehara (JP); Hideyuki Makita, Yokohama (JP); Tadashi Mimura, Yamato (JP); Satoru Tobita, Atsugi (JP); Tomohiko Koda, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 386 days.

(21) Appl. No.: 12/822,522

(22) Filed: Jun. 24, 2010

(65) Prior Publication Data

US 2010/0328409 A1 Dec. 30, 2010

(30) Foreign Application Priority Data

Jun. 29, 2009 (JP) ..... 2009-154180
Feb. 26, 2010 (JP) ..... 2010-042389

(51) Int. Cl.
*B41J 2/175* (2006.01)

(52) U.S. Cl. ..... 347/93

(58) Field of Classification Search ..... 347/54, 347/63, 65, 66, 85, 87, 93
See application file for complete search history.

(56) References Cited

U.S. PATENT DOCUMENTS 5,808,644 A * 9/1998 Imamura et al. ..... 347/93
5,841,455 A * 11/1998 Tanaka et al. ..... 347/87
7,229,159 B2 * 6/2007 Chikamoto et al. ..... 347/65
2008/0303884 A1 12/2008 Miura

FOREIGN PATENT DOCUMENTS

JP 2007-76093 3/2007
JP 2008-213196 9/2008

* cited by examiner

*Primary Examiner* — Anh T. N. Vo
(74) *Attorney, Agent, or Firm* — Cooper & Dunham LLP

(57) ABSTRACT

A liquid ejection head includes nozzles, separate chambers, a common chamber, inlet portions, a filter unit, and ribs. Droplets of liquid are ejected from the nozzles. The separate chambers are communicated with the nozzles. The inlet portions are communicated with the corresponding separate chambers. Liquid is supplied from the common chamber to the separate chambers through the inlet portions. The filter unit is disposed between the inlet portions and the common chamber to filter liquid in an area across the separate chambers in a first direction in which the nozzles are arrayed. The ribs are disposed in the filter unit at intervals corresponding in size to at least two of the separate chambers in the first direction to partition the filter unit. The inlet portions are communicated in the first direction with each other in at least one portion of each of the inlet portions facing the filter unit.

14 Claims, 19 Drawing Sheets

LIQUID EJECTION HEAD, LIQUID-DROPLET EJECTION DEVICE, AND IMAGE FORMING APPARATUS

CROSS-REFERENCE TO RELATED APPLICATIONS

The present patent application claims priority pursuant to 35 U.S.C. §119 from Japanese Patent Application Nos. 2009-154180, filed on Jun. 29, 2009 and 2010-042389, filed on Feb. 26, 2010 in the Japan Patent Office, each of which is incorporated herein by reference in its entirety.

BACKGROUND

1. Field

Exemplary embodiments of the present disclosure relate to an image forming apparatus, and more specifically to a liquid ejection head that ejects droplets of liquid, a liquid-droplet ejection device including the liquid ejection head, and an image forming apparatus including the liquid ejection head.

2. Description of the Background

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that uses a recording head formed with a liquid ejection head (liquid-droplet ejection head) for ejecting droplets of ink.

Such image forming apparatuses employing the liquid-ejection recording method eject droplets of ink or other liquid from the recording head onto a recording medium to form a desired image (hereinafter "image formation" is used as a synonym for "image recording" and "image printing"). Such liquid-ejection-type image forming apparatuses fall into two main types: a serial-type image forming apparatus that forms an image by ejecting droplets from the recording head while moving the recording head in a main scan direction, and a line-head-type image forming apparatus that forms an image by ejecting droplets from a linear-shaped recording head held stationary in the image forming apparatus.

Such a liquid ejection head supplies ink from an ink tank to a plurality of separate chambers (also referred to as pressure chambers or separate supply channels) via a common chamber and selectively applies pressure to ink in the separate chambers to eject liquid droplets from nozzles. Consequently, if at this time impurities, contaminated materials, or other foreign materials are mixed in with the ink supplied, these separate chambers may be blocked, causing clogging of the nozzles and ejection failure.

Hence, conventionally, a filter is disposed at a supply port of the common chamber. It is known that the closer the filter is located to the nozzles or the separate chambers, the more effectively the filter removes foreign materials. In another conventional technique, such a filter unit is formed in a diaphragm member between the common chamber and individual liquid-supply passages that supply liquid to the separate chambers. Further, in order to maintain good liquid supply to the separate chambers, communicating portions are formed in the partition walls between the individual liquid-supply passages at a side opposite a side facing the diaphragm member, thus causing the individual liquid-supply passages to be communicated with each other.

However, as described above, when the communicating portions are formed at the side facing the diaphragm member, the partition walls between the individual liquid-supply passages face the filter. As a result, a portion of the filter is shielded by the partition walls to narrow the filtering area, which is substantially the same as when the filter is provided for each of the separate chambers. Consequently, accumulation of even a slight amount of foreign materials may increase the proportion of a non-filtering area relative to the whole area of the filter, causing loss of pressure and a reduction in performance.

SUMMARY

In at least one exemplary embodiment, there is provided a liquid ejection head including a plurality of nozzles, a plurality of separate chambers, a common chamber, a plurality of inlet portions, a filter unit, and a plurality of ribs. Droplets of liquid are ejected from the plurality of nozzles. The plurality of separate chambers is communicated with the plurality of nozzles. Liquid is supplied from the common chamber to the separate chambers. The plurality of inlet portions is communicated with corresponding separate chambers. Liquid is supplied from the common chamber to the plurality of separate chambers through the plurality of inlet portions. The filter unit is disposed between the plurality of inlet portions and the common chamber to filter liquid in an area across the plurality of separate chambers in a first direction in which the plurality of nozzles is arrayed. The plurality of ribs is disposed in the filter unit at intervals corresponding in size to at least two of the separate chambers in the first direction to partition the filter unit. The plurality of inlet portions is communicated in the first direction with each other in at least one portion of each of the plurality of inlet portions facing the filter unit.

In at least one exemplary embodiment, there is provided a liquid ejection device including a liquid ejection head. The liquid ejection head includes a plurality of nozzles, a plurality of separate chambers, a common chamber, a plurality of inlet portions, a filter unit, and a plurality of ribs. Droplets of liquid are ejected from the plurality of nozzles. The plurality of separate chambers is communicated with the plurality of nozzles. Liquid is supplied from the common chamber to the separate chambers. The plurality of inlet portions is communicated with the corresponding separate chambers. Liquid is supplied from the common chamber to the plurality of separate chambers through the plurality of inlet portions. The filter unit is disposed between the plurality of inlet portions and the common chamber to filter liquid in an area across the plurality of separate chambers in a first direction in which the plurality of nozzles is arrayed. The plurality of ribs is disposed in the filter unit at intervals corresponding in size to at least two of the separate chambers in the first direction to partition the filter unit. The plurality of inlet portions is communicated in the first direction with each other in at least one portion of each of the plurality of inlet portions facing the filter unit.

In at least one exemplary embodiment, there is provided an image forming apparatus including a liquid ejection head. The liquid ejection head includes a plurality of nozzles, a plurality of separate chambers, a common chamber, a plurality of inlet portions, a filter unit, and a plurality of ribs. Droplets of liquid are ejected from the plurality of nozzles. The plurality of separate chambers is communicated with the plurality of nozzles. Liquid is supplied from the common chamber to the separate chambers. The plurality of inlet portions is communicated with the corresponding separate chambers. Liquid is supplied from the common chamber to the plurality of separate chambers through the plurality of inlet portions. The filter unit is disposed between the plurality of inlet portions and the common chamber to filter liquid in an area across the plurality of separate chambers in a first direction in which the plurality of nozzles is arrayed. The plurality of ribs is disposed in the filter unit at intervals corresponding in size to at least two of the separate chambers in the first direction to partition the filter unit. The plurality of inlet portions is communicated in the first direction with each other in at least one portion of each of the plurality of inlet portions facing the filter unit.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
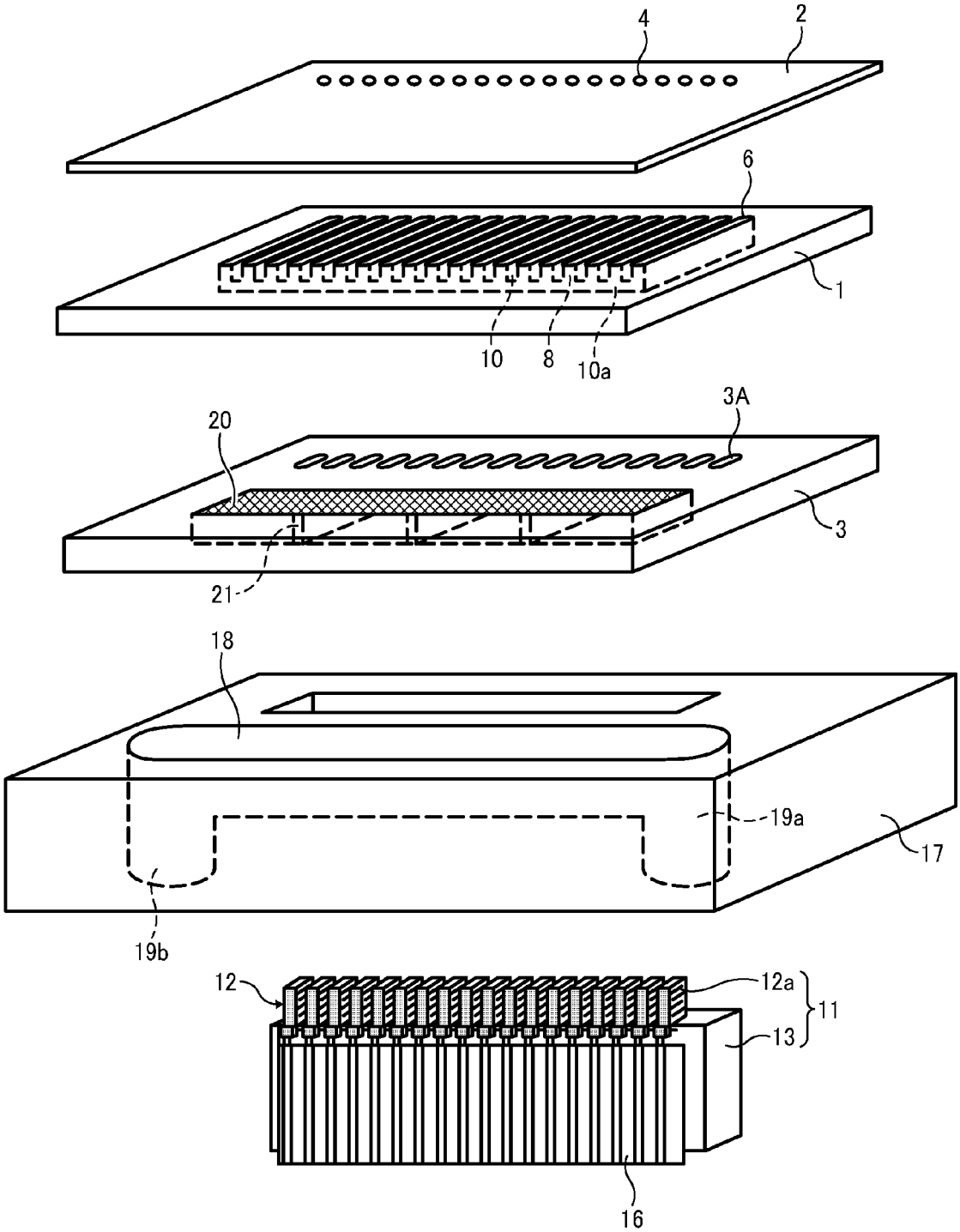
FIG. 1 is an exploded perspective view illustrating a liquid ejection head according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the present invention and all of the components or elements described in the exemplary embodiments of this disclosure are not necessarily indispensable to the present invention.

Below, exemplary embodiments according to the present disclosure are described with reference to attached drawings.

Figure 2:
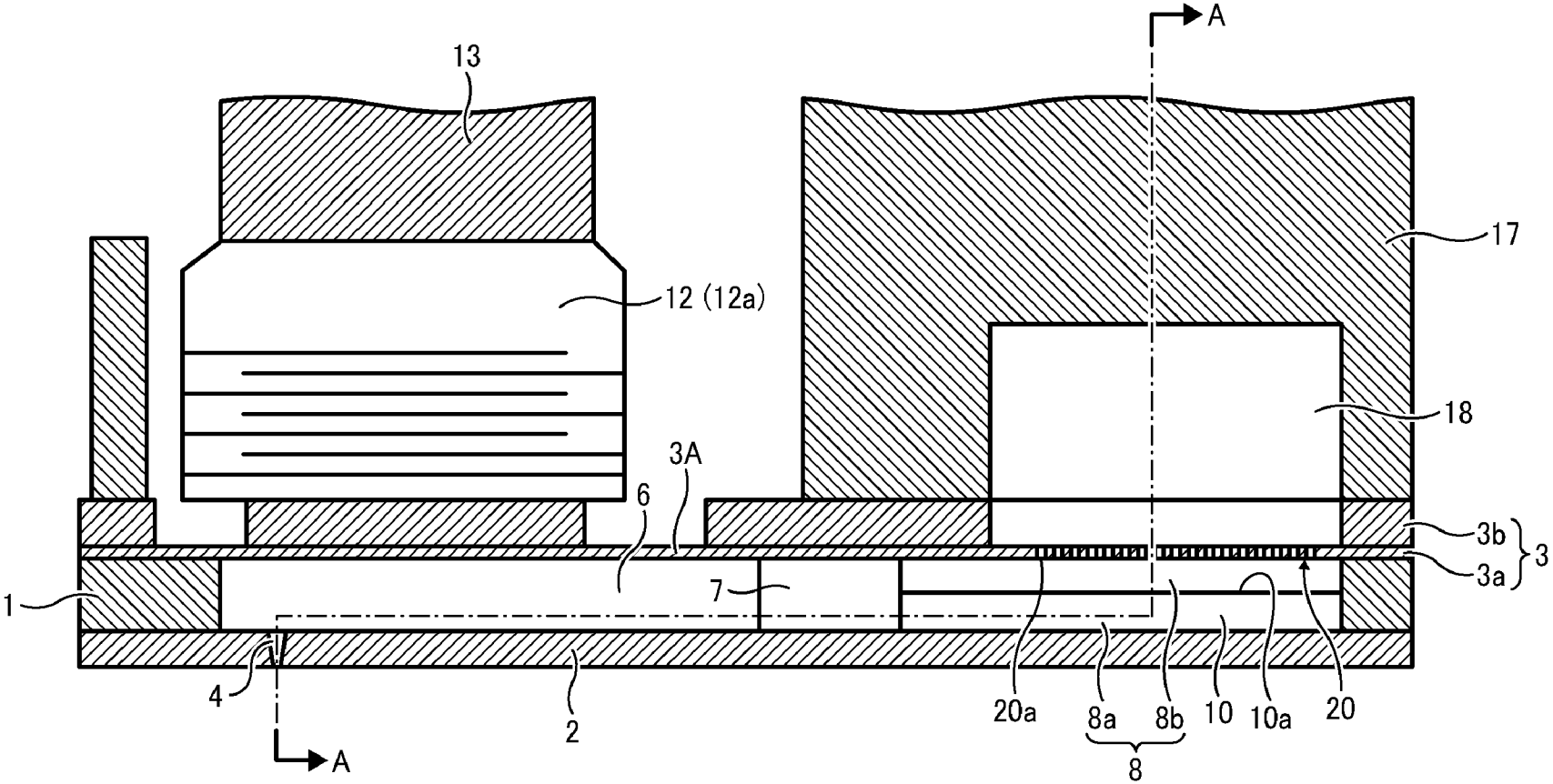
FIG. 2 is a cross-sectional view illustrating the liquid ejection head cut along a direction perpendicular to a direction in which nozzles are arrayed in the liquid ejection head illustrated in FIG. 1.
Figure 3:
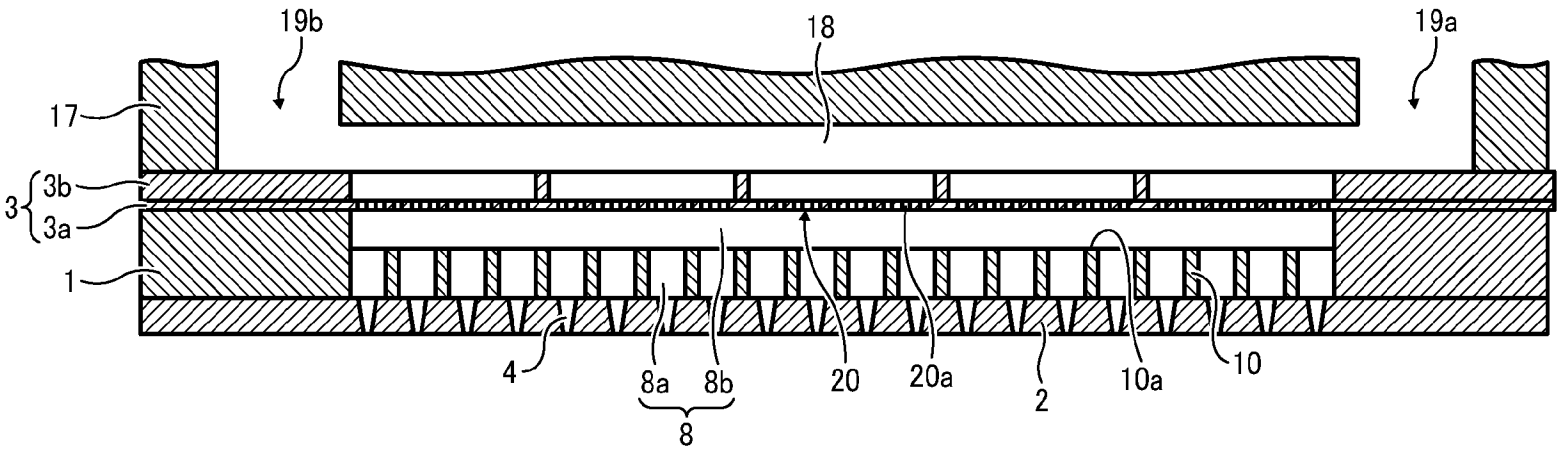
FIG. 3 is a sectional view illustrating the liquid ejection head cut along a line A-A illustrated in FIG. 2.

A liquid ejection head according to a first exemplary embodiment of the present disclosure is described with reference to FIGS. 1 to 3.

FIG. 1 is an exploded perspective view illustrating the liquid ejection head. FIG. 2 is a cross-sectional view illustrating the liquid ejection head cut along a direction perpendicular to a direction in which nozzles are arrayed in the liquid ejection head. FIG. 3 is a sectional view illustrating the liquid ejection head cut along a line A-A illustrated in FIG. 2.

The liquid ejection head includes a channel plate (restrictor plate) 1 as a channel member (chamber formation member), a nozzle plate 2 bonded to an upper face of the channel plate 1, and a diaphragm member 3 bonded to a lower face of the channel plate 1. A plurality of pressure chambers 6, a plurality of resistance portions 7, and a plurality of liquid inlet portions 8 are formed in the channel plate 1, the nozzle plate 2, and the diaphragm member 3. The plurality of pressure chambers 6 serving as separate chambers is communicated with a plurality of nozzles 4 formed in the nozzle plate 2 from which ink droplets are ejected. A common chamber 18 is a common channel formed in a frame member 17. From the common chamber 18, ink is supplied to the pressure chambers 6 via a filter unit 20 described below, the liquid inlet portions 8, and the resistance portions 7.

In the channel plate 1, opening portions of the pressure chambers 6, the resistance portions 7, and the liquid inlet portions 8 are formed by stamping SUS (stainless steel). The nozzle plate 2 includes the plurality of nozzles 4 each having a diameter of, for example, approximately 10 to 30 μm, corresponding to the respective pressure chambers 6. The nozzle plate 2 is bonded to the channel plate 1 with adhesive. The nozzle plate 2 may be formed by, for example, Ni electroformation or of another metal such as stainless, resin such as polyimide resin film, silicon, or a combination of the foregoing materials. Further, a repellent layer is formed on a nozzle face (a surface of the nozzle plate 2 from which ink is ejected to the outside) by, for example, metal coating and repellent coating using known methods, to preserve the hydrophobic properties of the ink.

In the diaphragm member 3, a first layer 3*a* and a second layer 3*b* are formed by, for example, Ni electroformation. The first layer 3*a* includes a diaphragm area 3A and the filter unit 20 described later, and the second layer 3*b* includes a thick-walled portion.

A piezoelectric actuator 11 that deforms the diaphragm area 3A is disposed on an outer surface of the diaphragm area 3A opposite a surface facing the pressure chambers 6. In the piezoelectric actuator 11, a piezoelectric-element member 12 including a plurality of piezoelectric-element pillars 12*a* is bonded to a base substrate 13. The piezoelectric-element member 12 is fixed on the base substrate 13 and grooved (slit) to form the plurality of piezoelectric-element pillars 12*a*. The piezoelectric-element member 12 is, for example, a multilayer piezoelectric element in which piezoelectric-element layers of PZT (lead zirconate titanate) having a thickness of approximately 10 to 50 μm per layer and internal-electrode layers of AgPd (silver palladium) having a thickness of several micrometers per layer are alternately laminated. The piezoelectric-element pillars 12*a* of the piezoelectric actuator 11 are connected to a flexible wiring substrate 16 such as a flexible printed circuit (FPC) that transmits driving signals.

The frame member 17 surrounding the piezoelectric actuator 11 is bonded to the diaphragm member 3 with adhesive. The common chamber 18 is formed in the frame member 17. Ink is circulated from the outside to the common chamber 18 via a supply port 19*a* and outputted to the outside via an outlet port 19*b*. The common chamber 18 is communicated with the liquid inlet portions 8, the resistance portions 7, and the pressure chambers 6 via the filter unit 20.

For the liquid ejection head thus configured, for example, when the voltage applied to the piezoelectric-element pillars 12*a* of the piezoelectric-element member 12 is reduced below a reference potential, the piezoelectric-element pillars 12*a* contract. As a result, the diaphragm area 3A of the diaphragm member 3 is deformed to increase the volume of the corresponding pressure chambers 6, causing ink to flow into the pressure chambers 6. By contrast, when the voltage applied to the piezoelectric-element pillars 12*a* is increased, the piezoelectric-element pillars 12*a* extend in the direction in which the piezoelectric-element layers and the internal-electrode layers are laminated. As a result, the diaphragm area 3A is deformed toward the nozzles 4 to reduce the volume of the pressure chamber 6. Thus, ink in the pressure chamber 6 is subjected to pressure and ejected as ink droplets from the nozzle 4. When the voltage applied to the piezoelectric-element pillars 12*a* is returned to the reference potential, the diaphragm area 3A is returned to the original position. At this time, the volume of the pressure chambers 6 is increased to generate negative pressure, thus causing ink to be supplied from the common chamber 18 to the pressure chambers 6. After vibration of the meniscus faces of the nozzles 4 decays into a stable state, the process proceeds to the next liquid ejection.

In this regard, it is to be noted that the method of driving the liquid ejection head is not limited to the above-described manner, i.e., a so-called pull-push driving method, and alternatively may be, for example, a pull driving method or push driving method.

Figure 5:
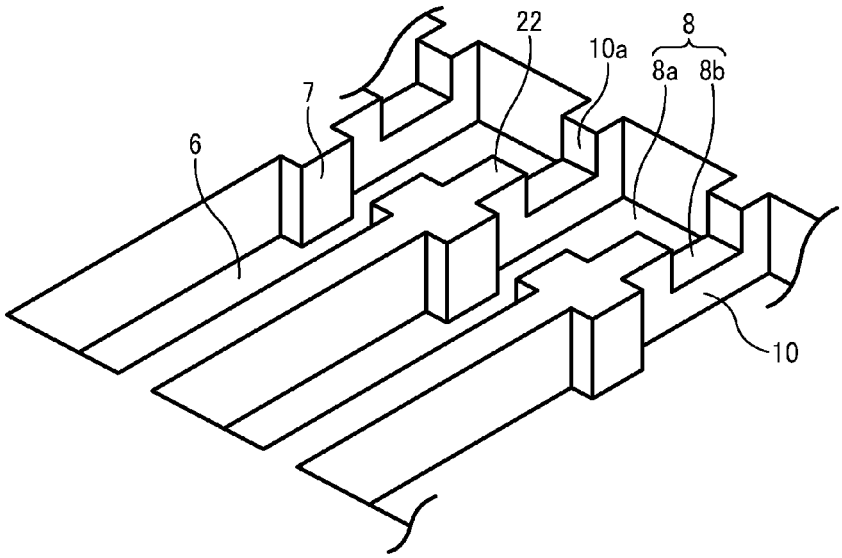
FIG. 5 is a perspective view illustrating a portion of the channel plate seen from the diaphragm-member side.
Figure 6:
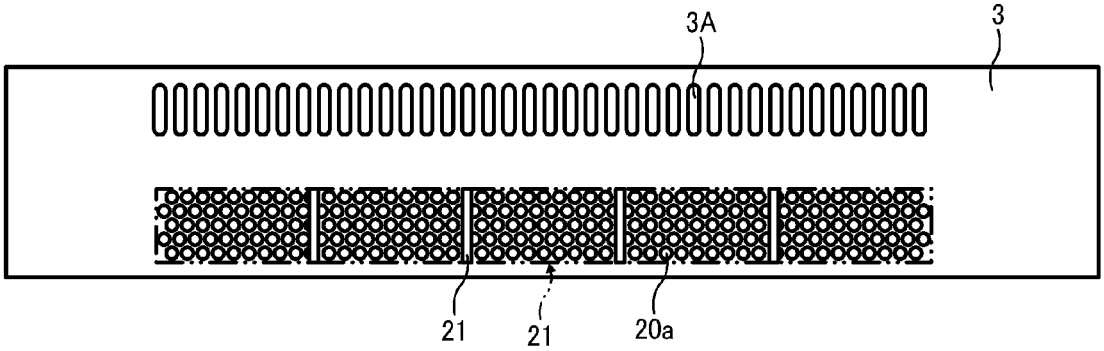
FIG. 6 is a plan view illustrating the diaphragm member seen from a common-chamber side.

Next, the liquid inlet portion 8 of the channel plate 1 and the filter unit 20 is described with reference to FIGS. 4 to 6.

Figure 4:
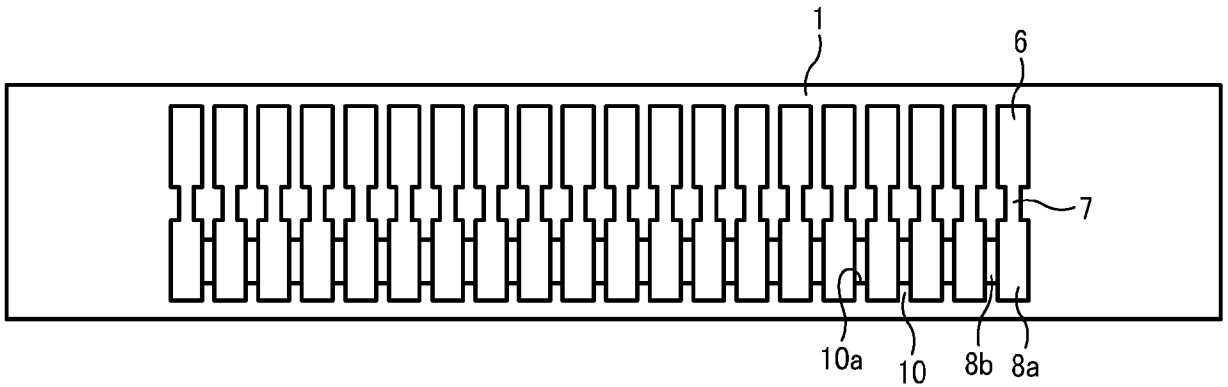
FIG. 4 is a plan view illustrating a channel plate seen from a diaphragm-member side.

FIG. 4 is a plan view illustrating the channel plate 1 seen from the diaphragm-member side. FIG. 5 is a perspective view illustrating a portion of the channel plate 1 seen from the diaphragm-member side. FIG. 6 is a plan view illustrating the diaphragm member 3 seen from the common-chamber side.

Recessed portions 10*a* are formed at the diaphragm-member side in partition walls 10 of the liquid inlet portions 8 communicated with the corresponding pressure chambers 6 recessed portions so as to communicate adjacent inlet portions 8*a* with each other. Each of the liquid inlet portions 8 includes the individual inlet portion 8*a* corresponding to each pressure chamber 6 and a communication portion 8*b* formed with the recessed portion 10*a* of the partition wall 10. The recessed portions 10*a* are formed by half etching. Thus, at a portion facing the filter unit 20 of the diaphragm member 3, the liquid inlet portions 8 are communicated with each other in the nozzle array direction.

Such a configuration prevents the filter unit 20 from being shielded by the partition walls 10 of the liquid inlet portions 8, thus securing an adequate area of the filter unit 20 to prevent a reduction in liquid supply.

As described above, the recessed portions 10*a* are formed by half-etching the channel plate 1 which is a single-piece member. It is conceivable that such a shape is formed by a first channel plate including the liquid inlet portions 8 and a second channel plate including the recessed portions 10*a*. However, such a configuration increases the number of components and/or production steps such as bonding, and, for example, misalignment of pieces might cause a level difference, resulting in accumulation of residual bubbles or other failure. Hence, in this exemplary embodiment, a single piece is employed to prevent such failures. Further, if the above-described bonded configuration is employed, a separate-chamber-side end portion 22 of each of the recessed portions

10*a* of the second channel plate is free from any other portion of the channel plate, and thus is prone to break, bend, and depart from its proper position. By contrast, in this exemplary embodiment, the recessed portions 10*a* are formed by half-etching the single-piece member, allowing the end portion 22 facing the recessed portion 10*a* to be formed in a stable shape instead of a free end.

Figure 7A:
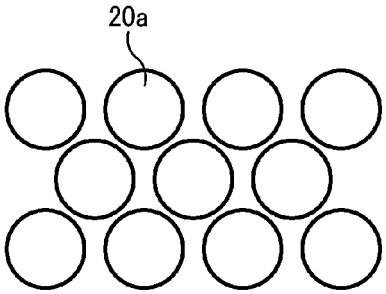
FIG. 7A is an enlarged view illustrating an example of arrangement of communication holes in a filter unit of the liquid-ejection head.
Figure 7B:
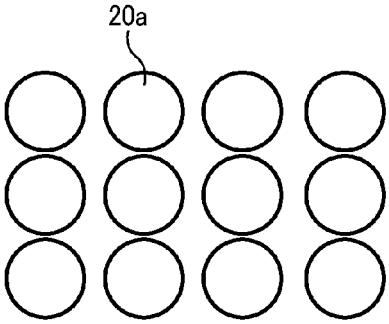
FIG. 7B is an enlarged view illustrating another example of arrangement of communication holes in the filter unit of the liquid-ejection head.
Figure 8A:
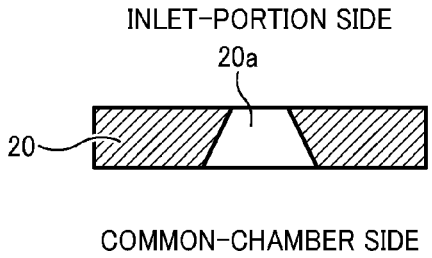
FIG. 8A is an enlarged view illustrating an example of shape of communication holes of the filter unit.
Figure 8B:
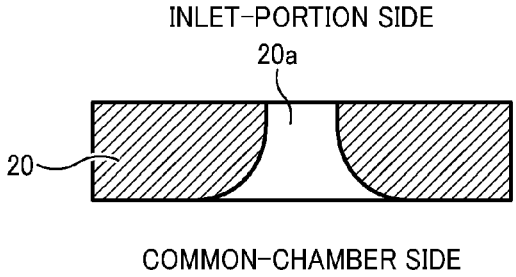
FIG. 8B is an enlarged view illustrating another example of shape of communication holes of the filter unit.

In the first layer 3*a* of the diaphragm member 3 between the common chamber 18 and the liquid inlet portion 8, the filter unit 20 is formed. The filter unit 20 filters liquid across the entire area of the pressure chambers 6 in the nozzle array direction. In the filter unit 20, a plurality of communication holes is arranged in, for example, a staggered form like that illustrated in FIG. 7A or a grid form like that illustrated in FIG. 7B. The interior of the communication holes 20*a* of the filter unit 20 may, for example, be tapered as illustrated in FIG. 8A or flared as illustrated in FIG. 8B. The diameter of the communication hole 20*a* is substantially equal to or smaller than the diameter of the nozzle 4.

Such shapes of the communication holes 20*a* can reduce fluid resistance, thus allowing stable supply of ink to the pressure chambers 6. Moreover, the planar shape of the communication hole 20*a* is not limited to the above-described circular shape, and may be, for example, a polygonal shape allowing effective arrangement of the communication hole 20*a*.

The filter unit 20 of the diaphragm member 3 includes a plurality of reinforcing ribs 21 at the common-chamber side. The ribs 21 are formed in the second layer 3*b* at a predetermined interval corresponding in size to, e.g., two or more pressure chambers 6. As described above, when the recessed portions (communication portion) 10*a* are formed in the partition walls 10 of the liquid inlet portions 8, the filter unit 20 of the diaphragm member 3 may be deformed by fluctuation in pressure involved with ink ejection. Hence, in this exemplary embodiment, the ribs 21 are disposed in the filter unit 20, thus preventing such deformation of the filter unit 20 due to fluctuation in pressure during ink ejection.

Figure 9:
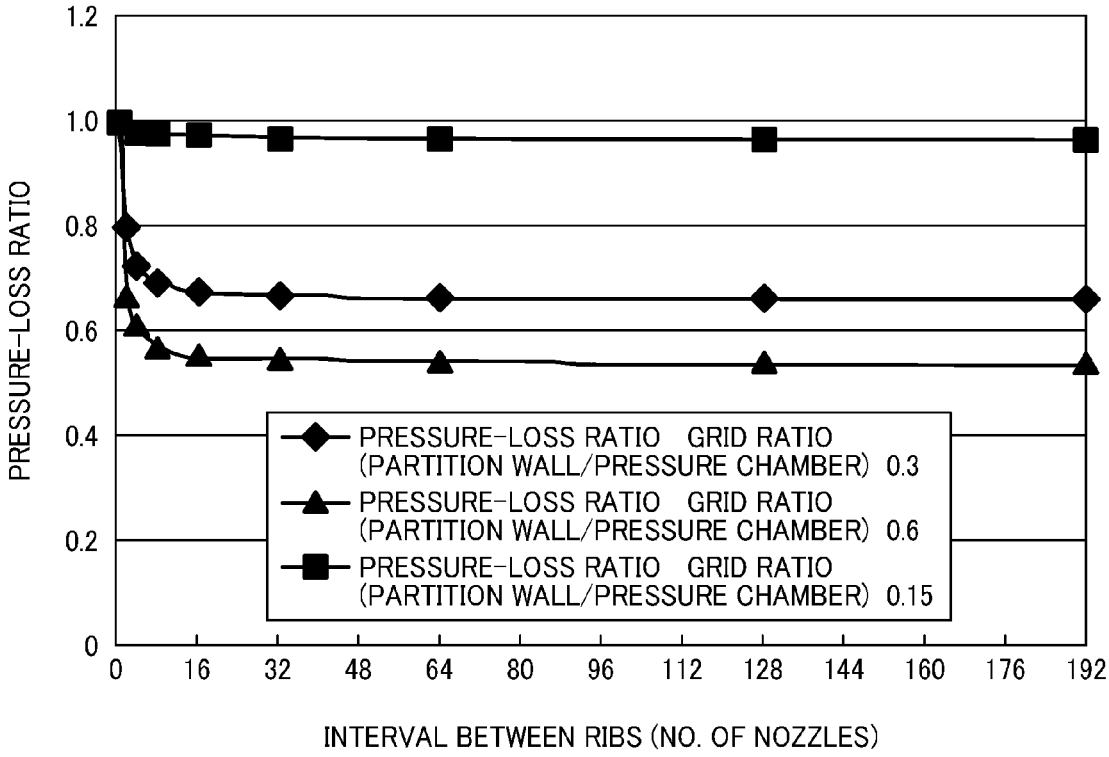
FIG. 9 is a chart showing an example of a relation between intervals of ribs (the number of nozzles) and pressure-loss ratio.

In this regard, the greater the interval between the ribs 21, the greater the filtering area of the filter unit 20 but the weaker the structural strength of the filter unit 20. FIG. 9 shows an example of the relation between the pressure loss ratio associated with the opening area of the filter unit 20 and the interval (number of nozzles) between the ribs 21.

As illustrated in FIG. 9, the greater the interval between the ribs 21, the smaller the pressure loss ratio. However, when the interval exceeds 16 in the number of nozzles, the pressure loss ratio is almost invariant and shows a difference of only one or two percent relative to when there are no ribs in the filter unit 20. Therefore, it is preferable that the interval between the ribs corresponds to approximately 16 nozzles or pressure chambers. In practice, however, the interval between the ribs may correspond to 8 to 32 separate chambers. The term "grid ratio" used herein means a ratio of the width of the partition wall between the pressure chambers to the width of the pressure chamber. As illustrated in FIG. 9, in any of the grid ratios listed, when the interval between ribs exceeds approximately 16 pressure chambers, the pressure loss ratio is almost invariant.

As described above, the liquid ejection head includes the filter unit that is disposed between the common chamber and the plurality of liquid inlet portions communicated with the plurality of separate chambers to filter liquid in the whole area of the plurality of separate chambers in the nozzle array direction. The plurality of liquid inlet portions is communicated with each other at a portion at the filter-unit side in the nozzle array direction, and the filter unit includes the ribs. Such a configuration prevents the filter unit from being shielded by the partition walls of the liquid inlet portions and secures the unshielded area of the filter unit. Such a configuration prevents a reduction in liquid supply while maintaining adequate stiffness of the filter unit, allowing for stable filtering performance.

Figure 10:
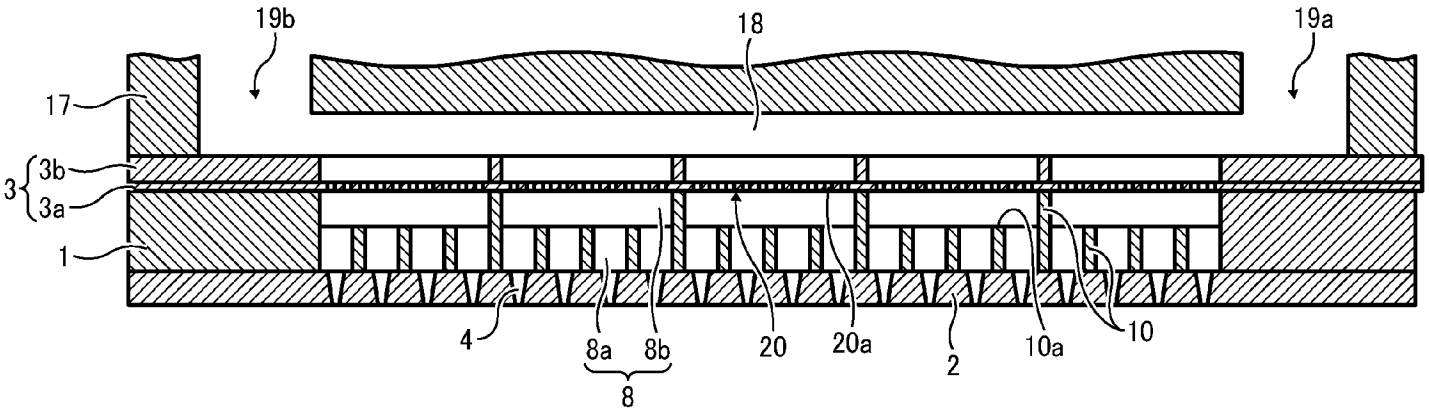
FIG. 10 is a cross-sectional view illustrating a liquid ejection head according to a second exemplary embodiment cut in a manner similar to FIG. 3.

Next, a liquid ejection head according to a second exemplary embodiment is described with reference to FIG. 10. FIG. 10 is a cross-sectional view illustrating the liquid ejection head cut in a manner similar to FIG. 3.

In this exemplary embodiment, the recessed portions 10*a* are not formed in the partition walls 10 of the liquid inlet portions 8 corresponding to the ribs 21 of the diaphragm member 3. Such a configuration securely prevents the diaphragm member 3 from being deformed by fluctuation in pressure. In such a configuration, when the partition walls 10 are bonded to the filter unit 20, adhesive might run off the edges to seal the communication holes 20*a* of the filter unit 20. Hence, in this exemplary embodiment, the partition walls 10 are bonded to the filter unit 20 at the positions of the ribs at which the communication holes 20*a* are not formed. Such a configuration allows the partition walls 10 to be bonded to the filter unit 20 without the sealing of the communication holes 20*a*, thus preventing a reduction in the filter area.

Next, a liquid ejection head according to a third exemplary embodiment is illustrated with reference to FIG. 11.

Figure 11:
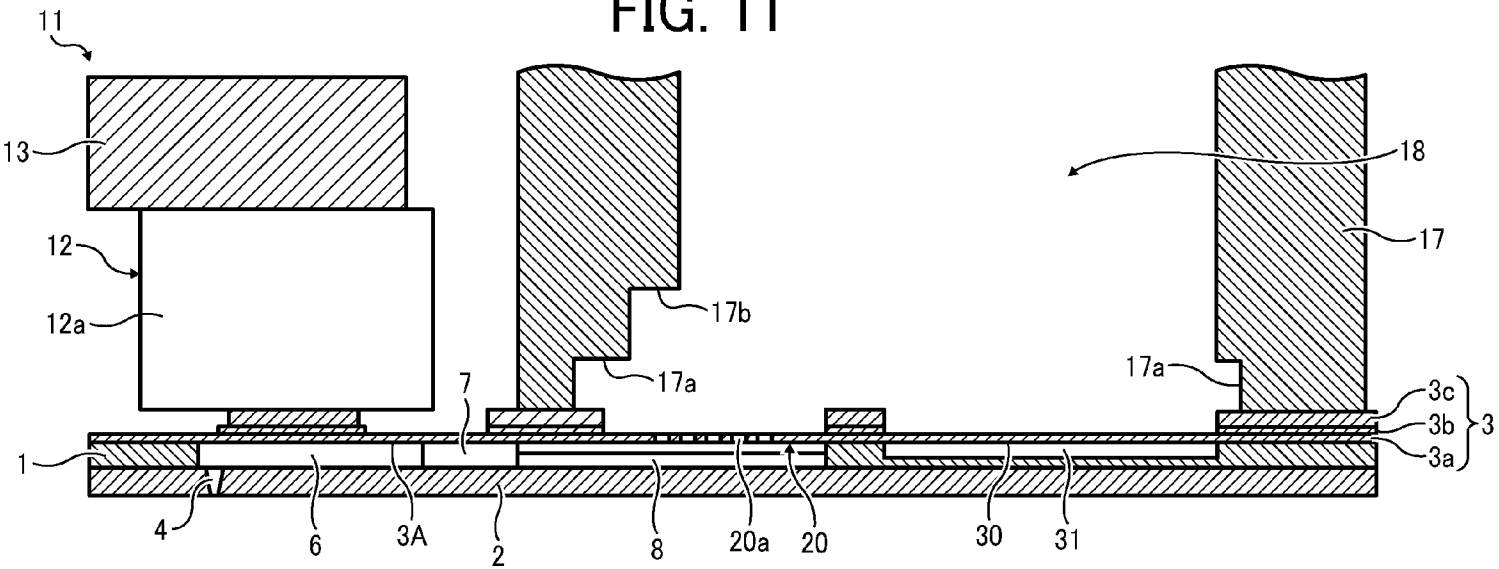
FIG. 11 is a cross-sectional view illustrating a liquid ejection head according to a third exemplary embodiment cut along a direction perpendicular to the nozzle array direction of the liquid ejection head.

FIG. 11 is a cross-sectional view illustrating the liquid ejection head cut along a direction perpendicular to the nozzle array direction of the liquid ejection head.

In this exemplary embodiment, a damper 30 is formed in a first layer 3*a* of a diaphragm member 3 to constitute a portion of a wall face of a common chamber 18. A damper chamber 31 is formed in a channel plate 1 so as to sandwich the damper 30 between the damper chamber 31 and the common chamber 18. In a frame member 17 including the common chamber 18, first step portions 17*a* are formed at both the filter-unit side and the dumber-side near the diaphragm member 3, and second step portions 17*b* are formed at the filter-unit side. The diaphragm member 3 has three layers: the first layer 3*a*, a second layer 3*b*, and a third layer 3*c*. The first layer 3*a* includes a diaphragm area 3A, the filter unit 20, and the damper 30.

In FIG. 11, steps are formed in the common chamber. However, it is to be noted that the interior shape of the common chamber is not limited to such a configuration and may be any other shape if the opening area becomes smaller as it is farther from the diaphragm member. For example, the interior of the common chamber may have a slant or round face. Alternatively, as illustrated in FIG. 9, the opening area may become greater toward both or either of the liquid inlet portion and the damper.

Such a stepwise configuration has advantages in processing the frame member, while the slant- or round-face configuration has advantages in preventing accumulation of residual bubbles.

As described above, in this exemplary embodiment, the common chamber 18 includes the step portions of the frame member 17. With such a configuration, even when the filter unit 20 and the damper 30 are disposed side by side, the area of the common chamber 18 facing both the filter unit 20 and the damper 30 is secured without upsizing the frame member 17, thus allowing downsizing the liquid ejection head. Further, the thickness of the frame member 17 is relatively small only near the diaphragm member 3 and sufficiently large in the other area, thus enhancing the strength of the liquid ejection head.

Next, a liquid ejection head according to a fourth exemplary embodiment is described with reference to FIGS. 12 to 16.

Figure 12:
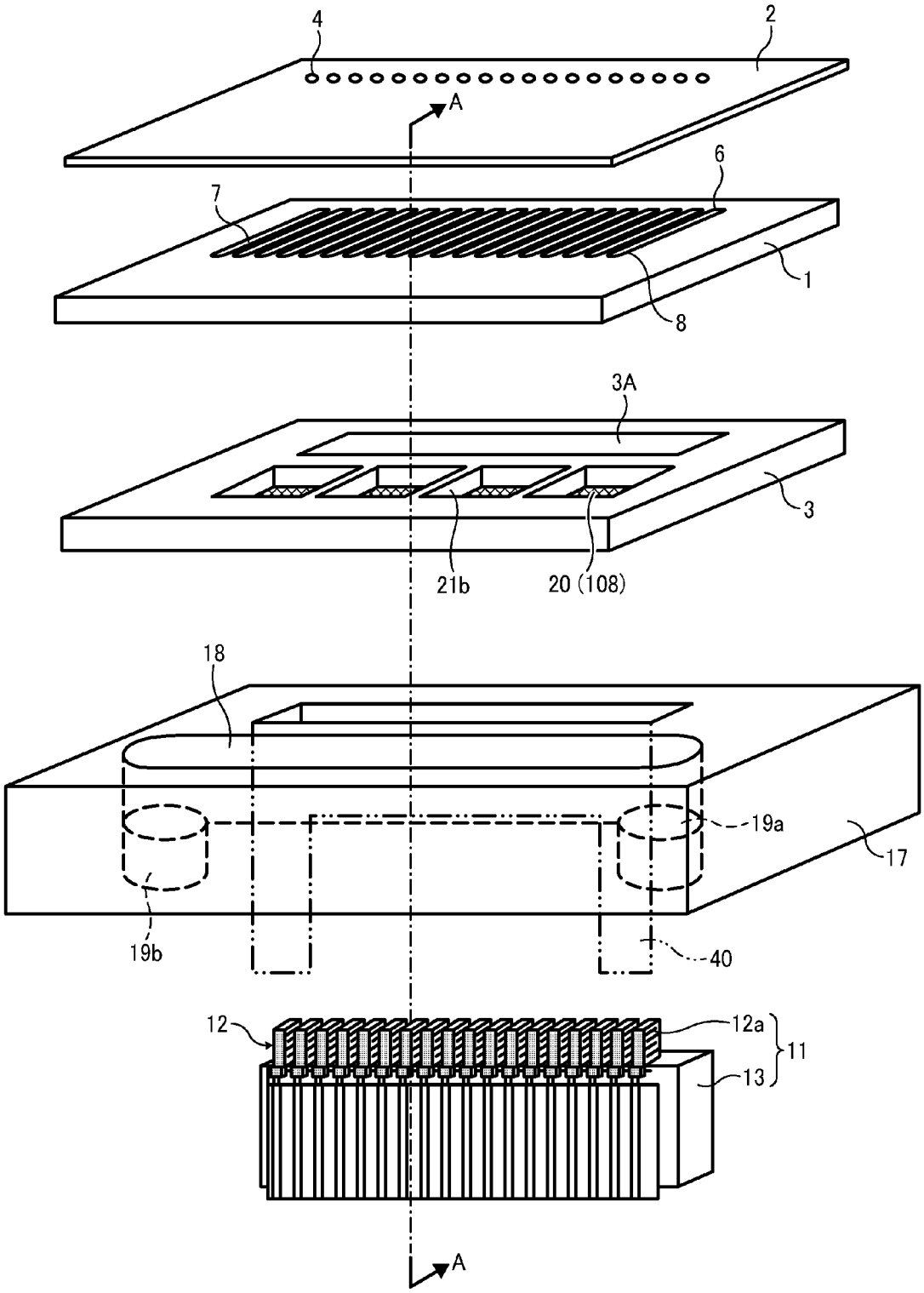
FIG. 12 is an exploded perspective view illustrating a liquid ejection head according to a fourth exemplary embodiment.
Figure 13:
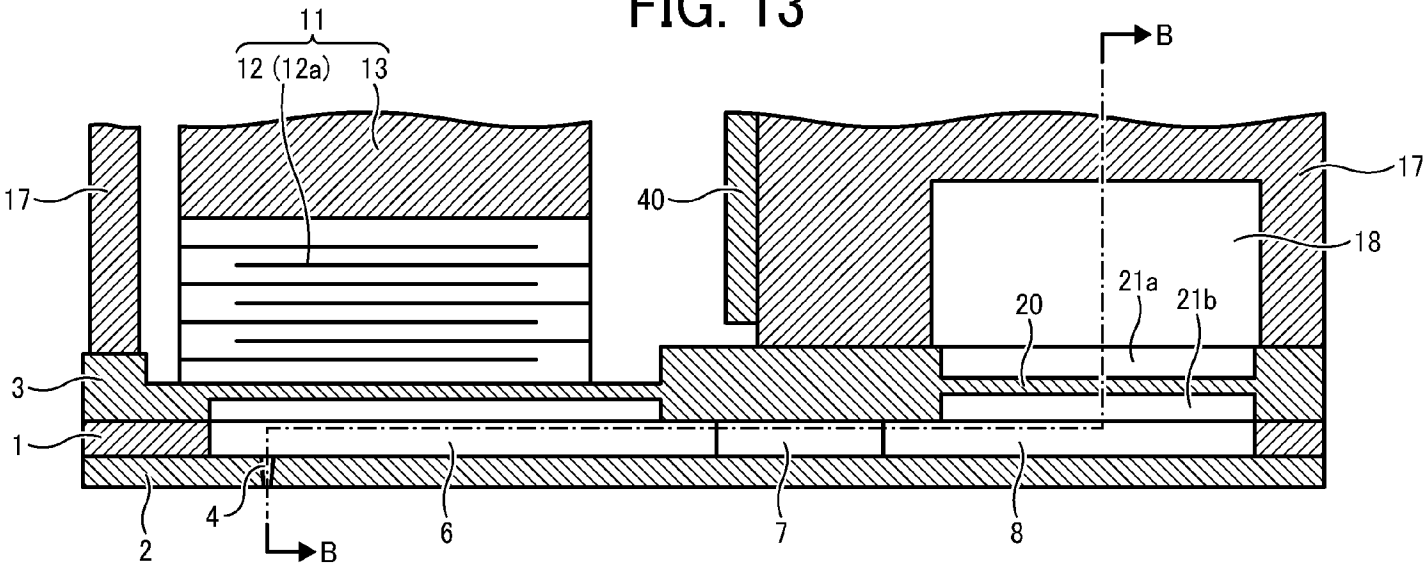
FIG. 13 is a cross-sectional view illustrating the liquid ejection head cut along a line A-A illustrated in FIG. 12.
Figure 14:
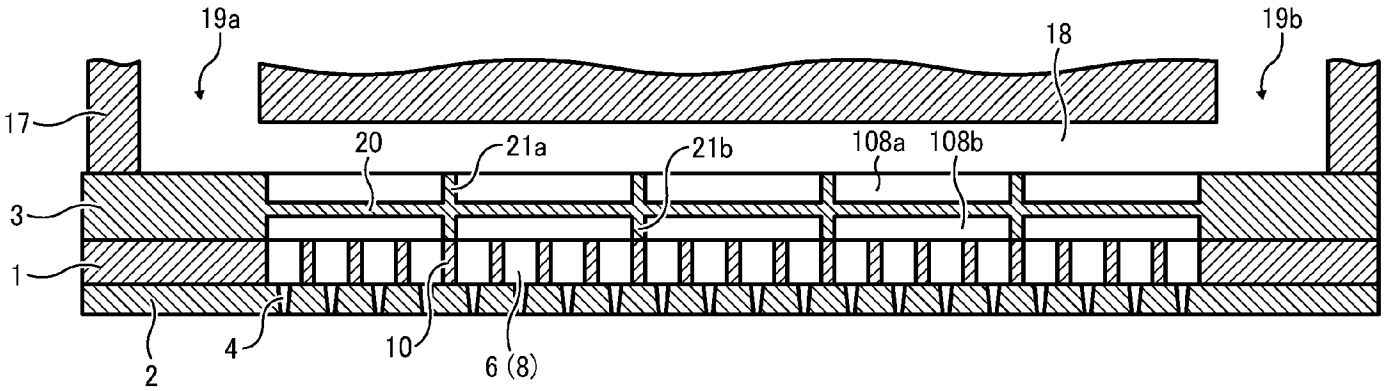
FIG. 14 is a cross-sectional view illustrating the liquid ejection head cut along a line B-B illustrated in FIG. 13.
Figure 15:
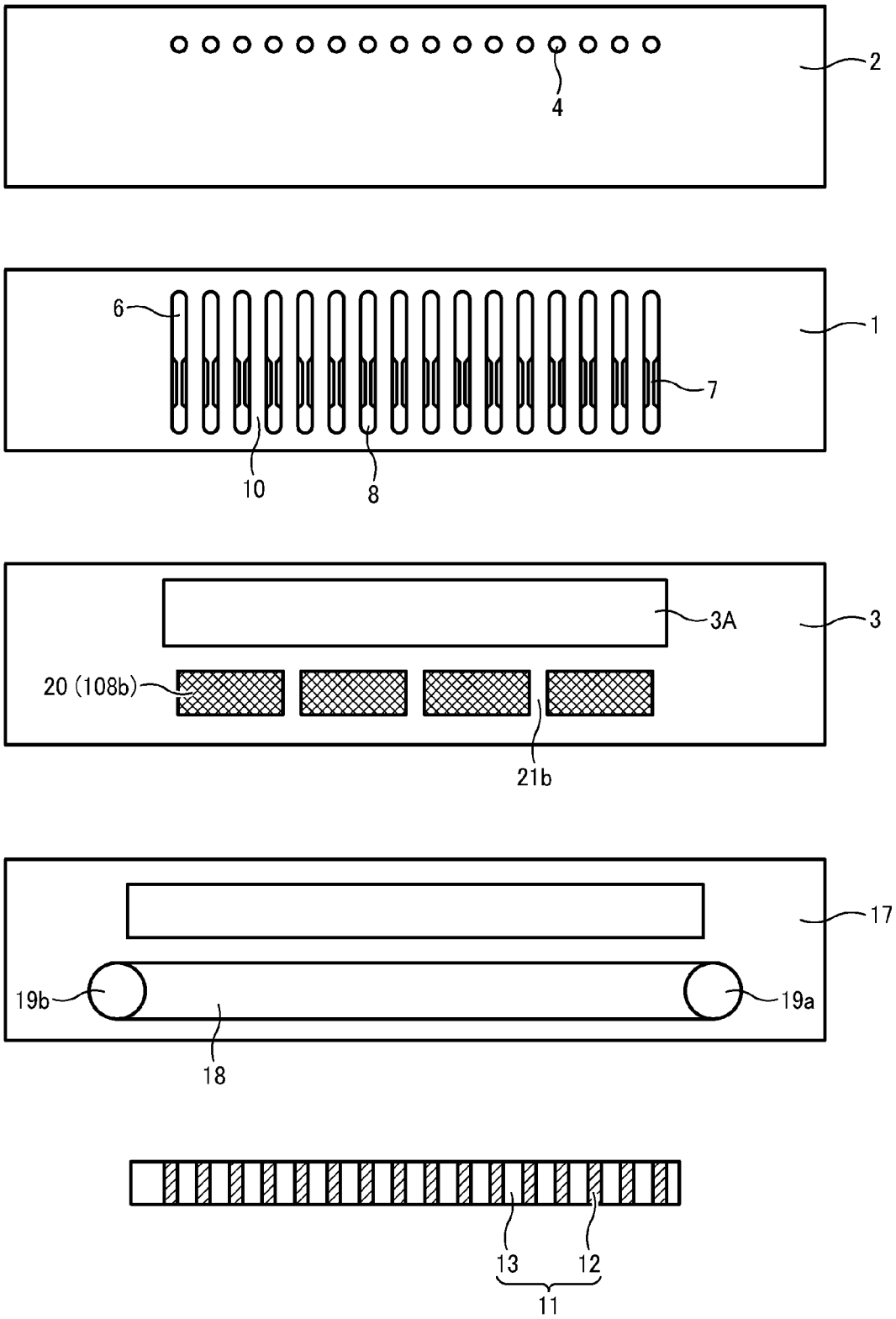
FIG. 15 is a plan view illustrating components of the liquid ejection head seen from the nozzle side.
Figure 16:
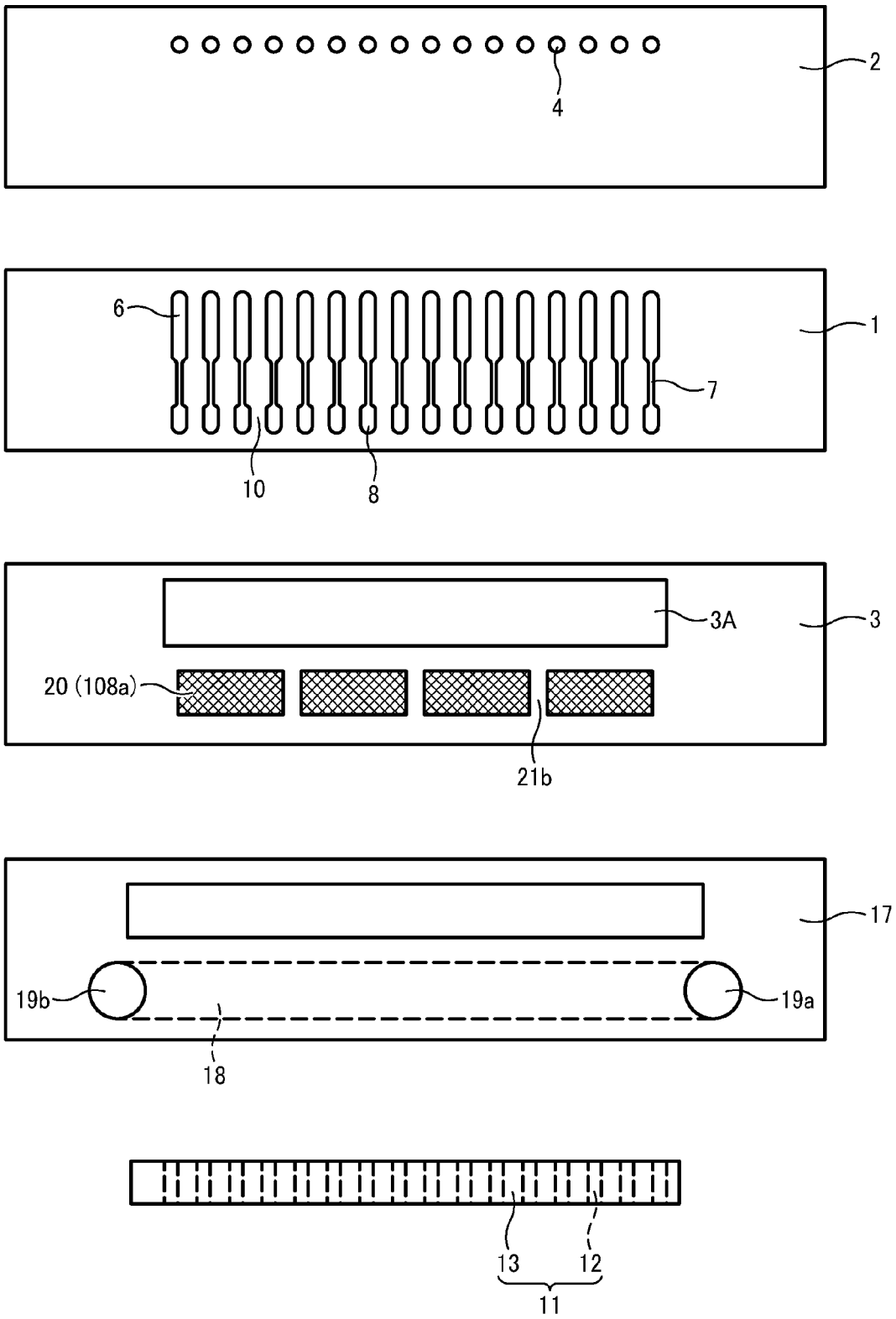
FIG. 16 is a plan view illustrating the components of the liquid ejection head seen from an actuator side.

FIG. 12 is an exploded perspective view illustrating the liquid ejection head according to the fourth exemplary embodiment. FIG. 13 is a cross-sectional view illustrating the liquid ejection head cut along a line A-A illustrated in FIG. 12. FIG. 14 is a cross-sectional view illustrating the liquid ejection head cut along a line B-B illustrated in FIG. 13. FIG. 15 is a plan view illustrating components of the liquid ejection head seen from the nozzle side. FIG. 16 is a plan view illustrating the components of the liquid ejection head seen from the actuator side.

As illustrated in FIG. 12, a heater 40 is attached to one side face of a common chamber 18 of a frame member 17. The heater 40 extends across substantially the whole length of the common chamber 18 in a direction in which nozzles 4 are arrayed.

Thus, the liquid ejection head according to this exemplary embodiment may employ ultraviolet curing ink (UV ink). The UV ink may have relatively high viscosity at room temperature. Hence, the heater previously heats the UV ink to reduce the viscosity.

Next, the configuration of a filter unit 20 in this exemplary embodiment is described.

A diaphragm member 3 in this exemplary embodiment has a three-layer structure as with the third exemplary embodiment. However, in this exemplary embodiment, the filter unit 20 is formed in a second layer which is an intermediate layer. Upstream ribs 21*a* are formed in a third layer at an upstream side (common-chamber side) in a direction in which liquid flows through the filter unit 20, and downstream ribs 21*b* are formed in a first layer at a downstream side (inlet-portion side) in a direction in which liquid flows through the filter unit 20.

In this exemplary embodiment, the recessed portions 10*a* described above are not formed in any of the partition walls 10 of the liquid inlet portions 8, and the liquid inlet portions 8 of the respective chambers are independent from each other. As illustrated in FIG. 14, the downstream ribs 21*b* partitioning the filter unit 20 are positioned opposite the partition walls 10 of the liquid inlet portions 8. The contact faces between the partition walls 10 and the downstream ribs 21*b* are bonded together with adhesive. Thus, the liquid inlet portions communicated with each other are formed with the downstream ribs 21*b* of the filter unit 20. Such a configuration obviates the formation of the recessed portions 10*a* in the partition walls 10, thus reducing the production steps.

Both the upstream ribs 21*a* and the downstream ribs 21*b* extend in a direction perpendicular to the nozzle array direction and evenly spaced in the nozzle array direction. Further, the upstream ribs 21*a* and the downstream ribs 21*b* are linearly aligned so as to overlap in the liquid flow direction.

Here, the relation between nozzle implementation density and grid ratio is described with reference to FIG. 17.

The grid ratio is obtained by Wb/Wa, where "Wa" represents the width of the pressure chamber 6 in the nozzle array direction and "Wb" represents the width of the partition wall 10 in the nozzle array direction. As illustrated in FIG. 14, the width of the partition wall 10 between the chambers in the nozzle array direction is set equal to the width Wb of each of the ribs 21*a* and 21*b* (collectively referred to as "ribs 21" unless distinguished).

Figure 17:
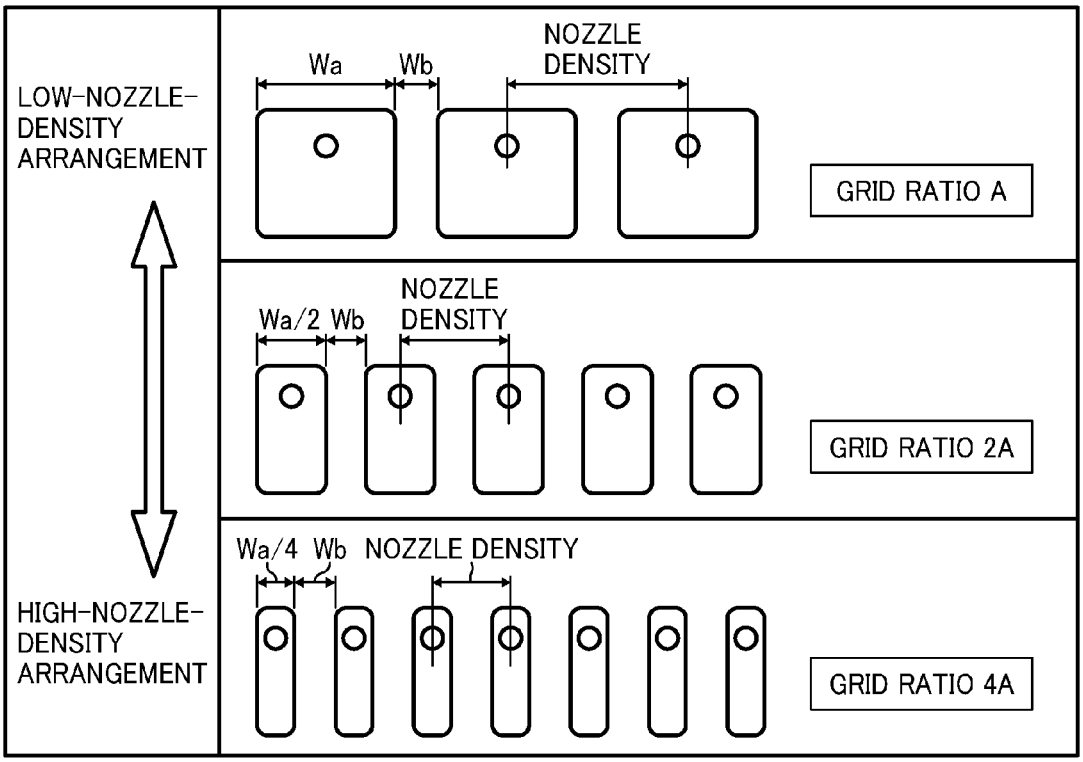
FIG. 17 is a diagram illustrating relation between nozzle implementation density and grid ratio.

The upper box of FIG. 17 shows a grid ratio "A" obtained when the width of the pressure chamber 6 is set to Wa and the width of the partition wall 10 is set to Wb. The middle box of FIG. 17 shows a grid ratio "2A" obtained when the width of the pressure chamber 6 is set to Wa/2 and the width of the partition wall 10 is set to Wb. The lower box of FIG. 17 shows a grid ratio "4A" obtained when the width of the pressure chamber 6 is set to Wa/4 and the width of the partition wall 10 is set to Wb. As illustrated in FIG. 17, each of the nozzles 4 is disposed at a middle position of the corresponding pressure chamber 6. Accordingly, the nozzle arrangement illustrated in the upper box of FIG. 17 shows a relatively low nozzle density, while the nozzle arrangement illustrated in the lower box of FIG. 17 shows a relatively high nozzle density.

In such a case, it is conceivable that the width of the pressure chamber 6 is set narrower to implement a high-density nozzle arrangement. However, such a configuration requires sufficient strength for handleability, e.g., adhesion pressure when a plurality of plates is layered. Consequently, the width of the partition wall 10 may not be narrowed in equal measure with the ratio of the pressure chambers 6.

Further, if the partition walls 10 are directly bonded to the filter unit 20, the area of the filter unit 20 shielded by the partition walls 10 is relatively large, resulting in an increase in pressure loss. Hence, in this exemplary embodiment, the ribs 21 are disposed in the filter unit 20 to prevent pressure loss while maintaining the strength of the filter unit 20.

Figure 18:
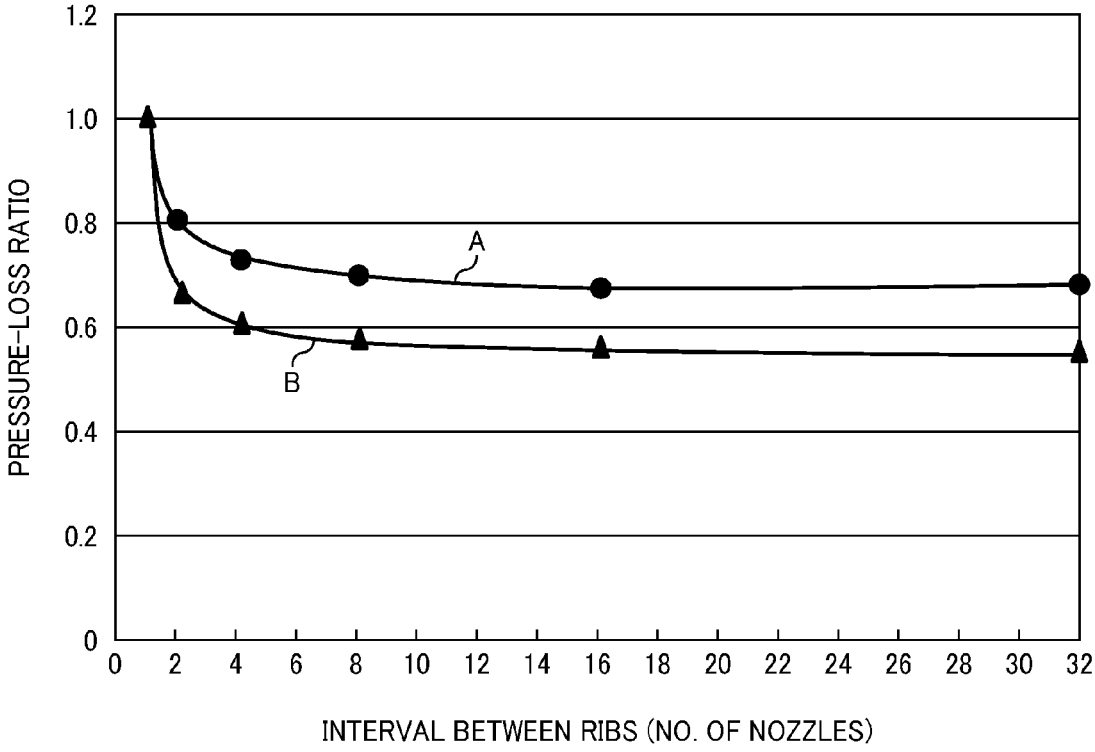
FIG. 18 is an enlarged chart showing a portion of FIG. 9.

FIG. 18 is an enlarged chart showing a portion of FIG. 9 corresponding to one to 32 nozzles. FIG. 18 also shows relation between the interval of the ribs 21 and the pressure loss in the filter unit 20.

The pressure loss ratio of the vertical axis represents a ratio of a pressure loss in an examined rib arrangement relative to a pressure loss (reference value) in a rib arrangement in which a gird portion is provided for each channel (i.e., the partition wall 10). That is, a pressure loss obtained when the ribs 21*a* and 21*b* are provided to each of the partition walls 10 (i.e., both the number of the ribs 21*a* and the number of the ribs 21*b* is identical to the number of the partition walls 10) is defined as the reference value "1", and the pressure loss ratio is obtained from a ratio of a pressure loss in an examined rib arrangement relative to the reference value. The rib position of the horizontal axis shows the interval (spacing) between the ribs 21*a* and 21*b*. For example, if the rib interval is 4, four chambers are provided between adjacent ribs 21. In FIG. 18, the line A shows a relation between the interval of ribs (number of nozzles) and the pressure loss ratio at a grid ratio of 0.3, and the line B shows a relation at a grid ratio of 0.6.

As illustrated in FIG. 18, in both the lines A and B, when the rib interval (number of nozzles) is two, the pressure loss ratio is still high. However, as the number of nozzles increases from 4 via 8 to 16, the pressure loss decreases. Further, when the number of nozzles exceeds 16, the effect of the rib interval in reducing pressure loss is almost invariant. Rather, as the number of ribs decreases, other effects of the ribs, such as an increase in the mechanical strength of the filter unit and uniform distribution of heat from the heater, may not be sufficiently obtained. Hence, in this exemplary embodiment, it is preferable that the ribs 21*a* and 21*b* are positioned for each of 4 to 16 partition walls between chambers.

From the point of view of the strength of the channel plate, it is preferable that the grid ratio is, for example, 0.3 or more.

The ribs 21*a* and 21*b* are evenly disposed on the upper and lower faces of the filter unit 20 at a predetermined interval so that the upper and lower faces of the filter unit 20 are formed in recess shape, thus enhancing the handleability of the filter unit.

The fourth exemplary embodiment is further described with reference to FIGS. 19A and 19B.

Figure 19A:
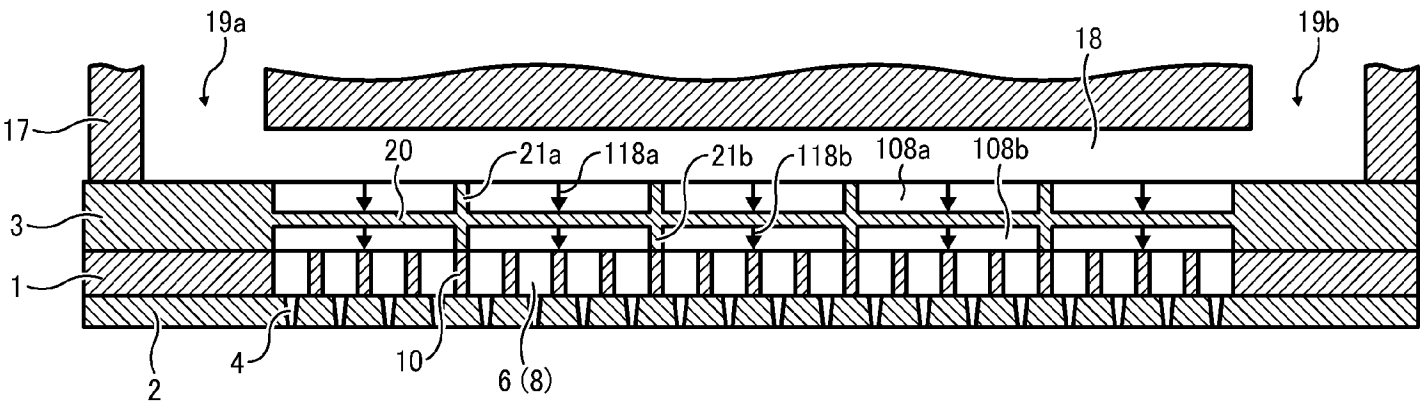
FIG. 19A is a schematic view illustrating flow of ink in the liquid ejection head according to the fourth exemplary embodiment.

FIG. 19A is a schematic view illustrating flow of ink in this exemplary embodiment. FIG. 19B is a schematic view illustrating flow of ink in a comparative example in which the downstream ribs 21*b* are not provided.

Figure 19B:
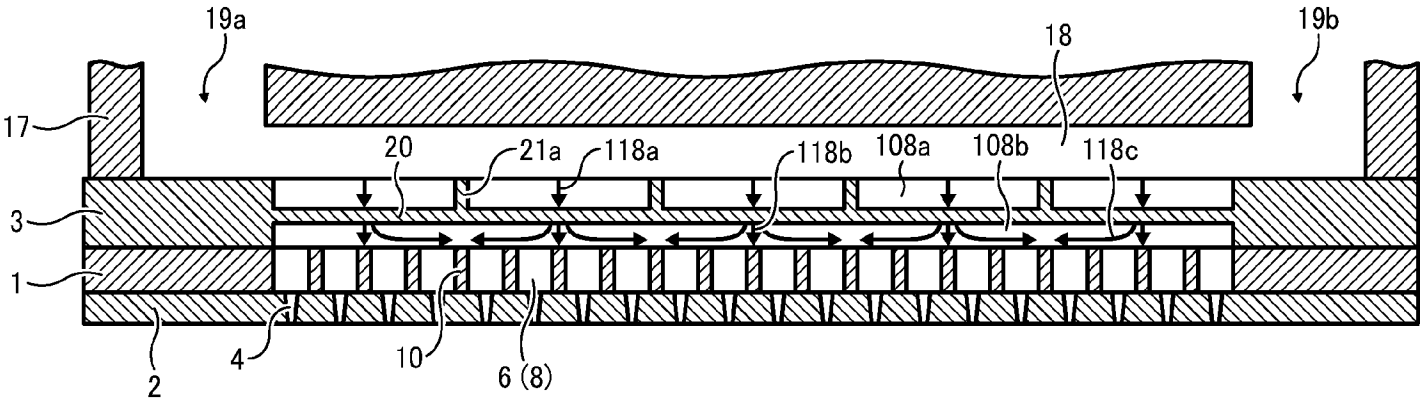
FIG. 19B is a schematic view illustrating flow of ink in a liquid ejection head according to a comparative example in which downstream ribs are not provided.

As illustrated in FIG. 19B, if the downstream ribs 21*b* are not provided, a large space of the common chamber 18 is formed below the filter unit 20. As a result, a sharp change in the cross-sectional area before and after ink passes through the filter unit 20 causes turbulent flow 118*c*, causing pressure loss. Further, the turbulent flow 118*c* causes stagnation in the flow of ink near the filter unit 20. As a result, bubbles may be generated, adversely affecting ink ejection performance.

By contrast, as illustrated in FIG. 19A, in this exemplary embodiment, the upstream ribs 21*a* and the downstream ribs 21*b* are disposed at the corresponding positions on the upstream side and the downstream side, respectively, of the filter unit 20. As a result, the upstream and downstream sides of the filter unit 20 are divided into a plurality of upstream ink chambers 108*a* and a plurality of downstream ink chambers 108*b* forming part of the liquid inlet portions 8, respectively. Accordingly, the cross-sectional areas before and after ink passes through the filter unit 20 are the same. Ink flow 118*a* flowing into the upstream ink chambers 108*a* passes through the filter unit 20 and then through the downstream ink chambers 108*b* as the ink flow 118*b* illustrated in FIG. 19A. Thus, the downstream ribs 21*b* also serve as rectifying plates of ink, preventing the above-described failures, such as the turbulent flow 118*c*, bubbles, or stagnation of ink flow near the filter unit 20.

Next, heat convection arising in using the heater 40 is described with reference to FIGS. 20A and 20B.

Figure 20A:
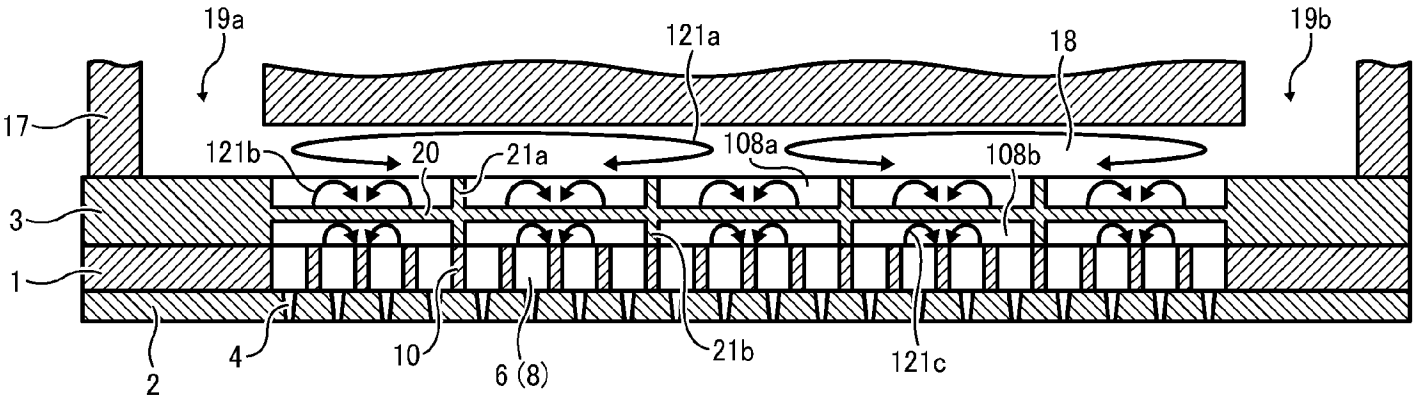
FIG. 20A is a schematic view illustrating heat convection in the liquid ejection head according to the fourth exemplary embodiment.

FIG. 20A is a schematic view illustrating heat convection in this exemplary embodiment. FIG. 20B is a schematic view illustrating heat convection in a comparative example in which the downstream ribs 21*b* are not provided.

The liquid ejection head heats ink with the heater 40 to reduce the viscosity of ink and ejects such reduced-viscosity ink. In the liquid ejection head, when the amount of droplets ejected per unit of time is relatively great in high-speed printing, ink around the supply ports 19 may not be sufficiently heated, resulting in relatively low temperature. By contrast, ink around the common chamber 18 of the frame member 17 is heated with the heater 40, resulting in relatively high temperature.

Figure 20B:
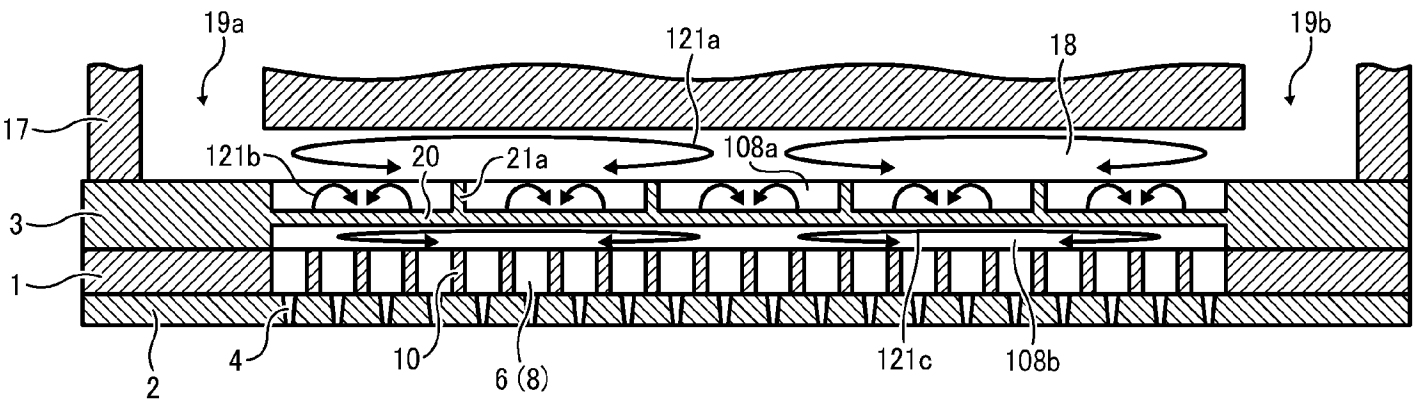
FIG. 20B is a schematic view illustrating heat convection in a liquid ejection head according to a comparative example in which downstream ribs are not provided.

Accordingly, as illustrated in FIGS. 20A and 20B, relatively-large heat convection 121*a* arises in the common chamber 18 while relatively-small heat convection 121*a* arises in the upstream ink chambers 108*a*.

As illustrated in FIG. 20B, when the downstream ribs 21*b* are not provided, the relatively-large downstream ink chambers 108*b* are formed in the diaphragm member 3. As a result, relatively-low ink temperature around the supply ports 19 and relatively-high ink temperature in the common chamber 18 cause relatively-large heat convection 121*c*. Such large heat convection 121*c* in the large space may cause uneven temperature distribution in the downstream ink chambers 108*b*. Accordingly, the viscosity of ink supplied to the pressure chambers 6 varies, resulting in a variance in ejection performance between the nozzles 4.

Hence, in this exemplary embodiment, the plurality of the downstream ink chambers 108*b* is provided with the downstream ribs 21*b*, and as illustrated in FIG. 20A, the heat convection 121*c* is smaller than in the comparative example illustrated in FIG. 20B. As a result, uneven distribution of the ink viscosity is suppressed, thus reducing variation in ejection performance between the nozzles 4.

Next, a liquid ejection head according to a fifth exemplary embodiment is described with reference to FIGS. 21, 22A and 22B.

Figure 21:
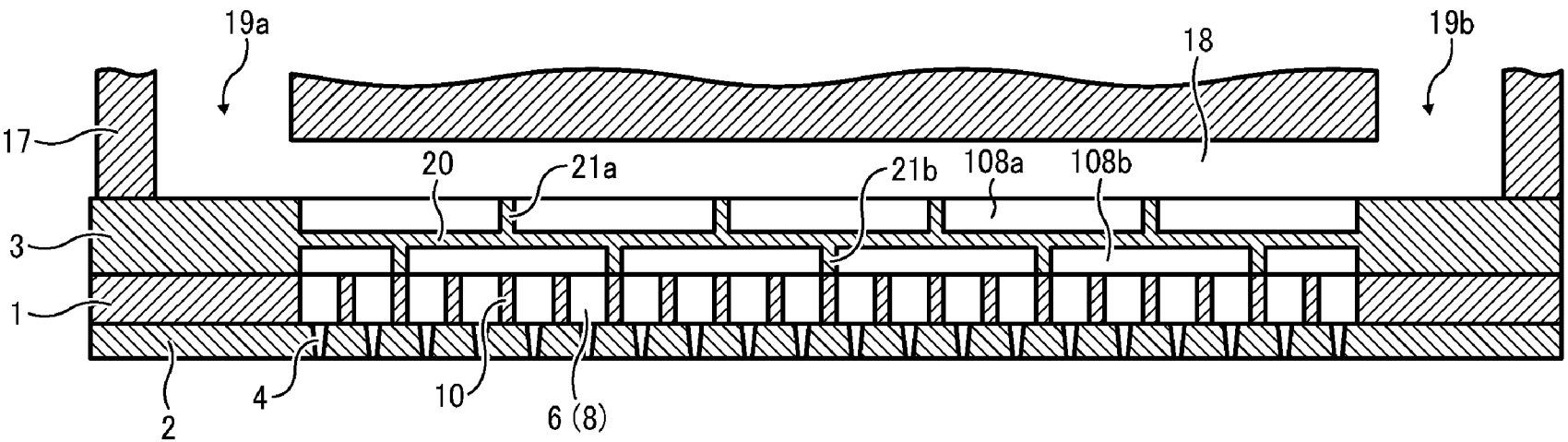
FIG. 21 is a cross-sectional view illustrating a liquid ejection head according to a fifth exemplary embodiment.
Figure 22A:
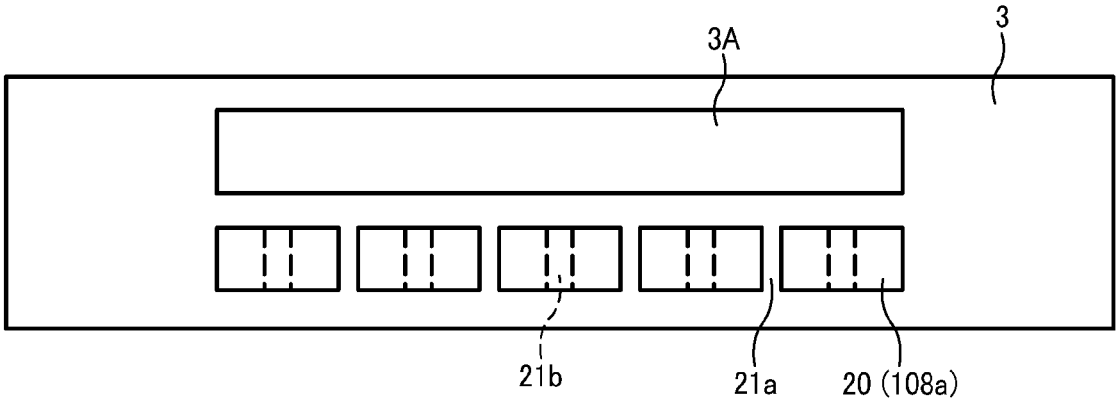
FIG. 22A is a plan view illustrating a diaphragm member seen from the nozzle side.
Figure 22B:
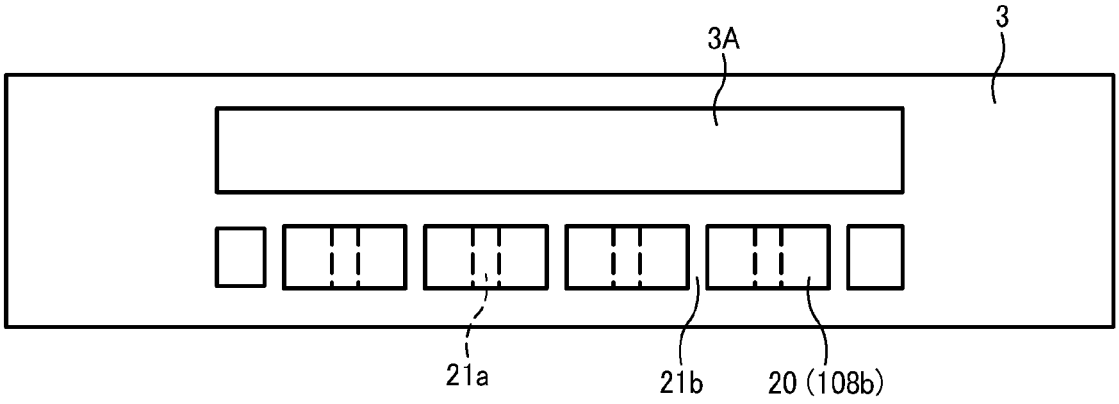
FIG. 22B is a plan view illustrating the diaphragm member seen from the actuator side.

FIG. 21 is a cross-sectional view illustrating the liquid ejection head according to the fifth exemplary embodiment. FIG. 22A is a plan view illustrating a diaphragm member 3 seen from the nozzle side. FIG. 22B is a plan view illustrating the diaphragm member seen from the actuator side.

In this exemplary embodiment, the positions of the upstream ribs 21*a* and the downstream ribs 21*b* are shifted in the projection plane, and the upstream ribs 21*a* are disposed in a middle portion between the downstream ribs 21*b*. In FIG. 21, the interval between the upstream ribs 21*a* is set equal to the interval between the downstream ribs 21*b*.

In this configuration, when the interval between the downstream ribs 21*b* is set corresponding to a plurality of, e.g., four, six, or eight, partition walls 10, the upstream ribs 21*a* and the partition walls 10 are linearly aligned. Such a configuration prevents an increase in pressure loss caused by shifting the relative positions between the upstream ribs 21*a* and the downstream ribs 21*b*.

As described above, when the upstream ribs 21*a* and the downstream ribs 21*b* are shifted from each other in the nozzle array direction, the area of the thick portion bonded to the ribs 21 in the filter unit 20 is doubled. Such a configuration enhances the mechanical strength of the filter unit 20, reducing the risk of breaking in operation. If the pitch of the ribs is simply doubled in order to obtain the same effect, the filtering area of the filter unit would decrease, causing an increase in pressure loss. By contrast, in this exemplary embodiment, the above-described rib arrangement prevents such an increase in pressure loss, improving handleability.

Next, an image forming apparatus according to an exemplary embodiment that employs the liquid ejection head is described with reference to FIGS. 23 and 24.

Figure 23:
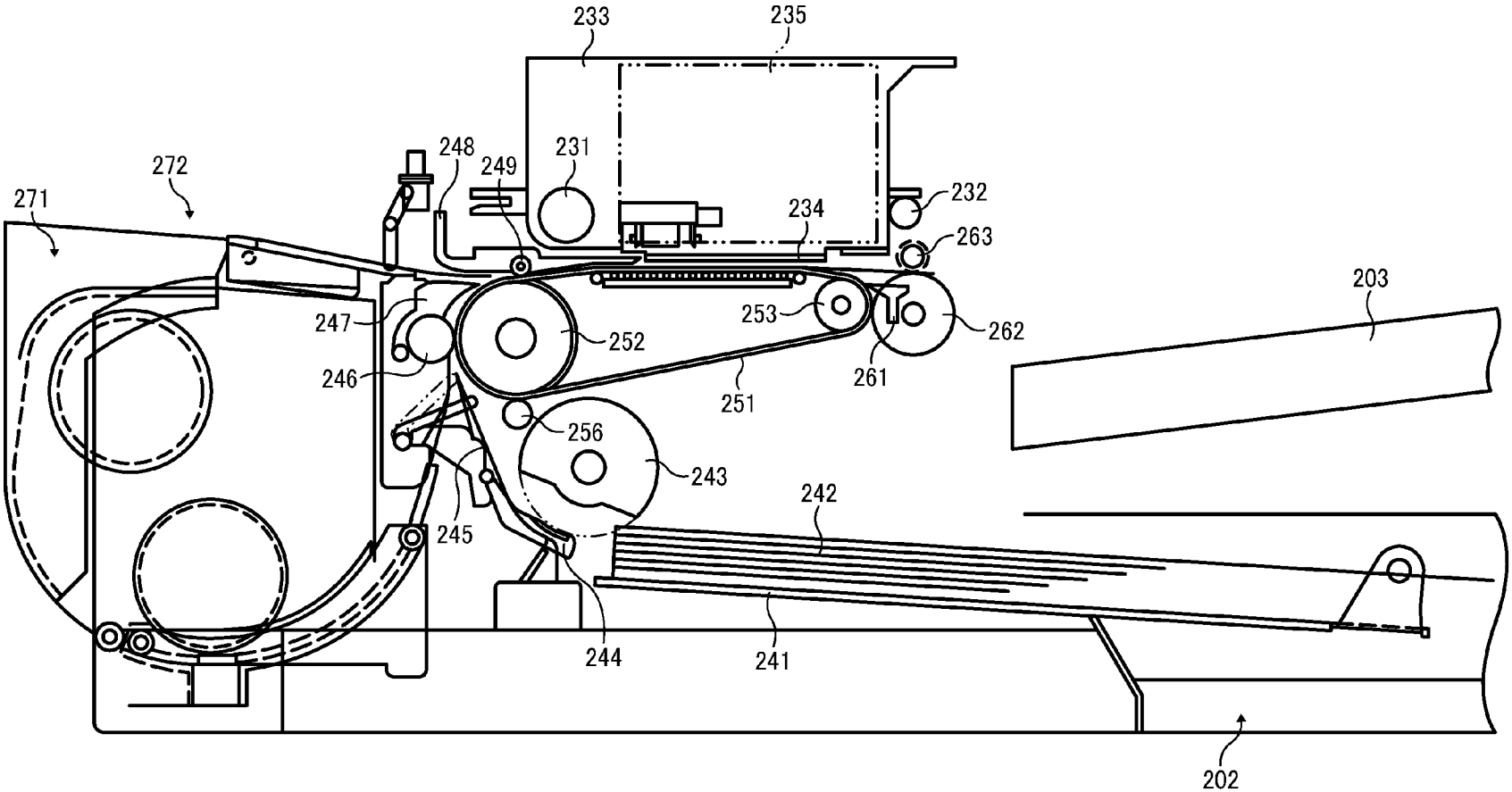
FIG. 23 is a schematic view illustrating an image forming apparatus according to an exemplary embodiment.

FIG. 23 is a schematic view illustrating a mechanical section of the image forming apparatus. FIG. 24 is a partial plan view illustrating the mechanical section illustrated in FIG. 23.

Figure 24:
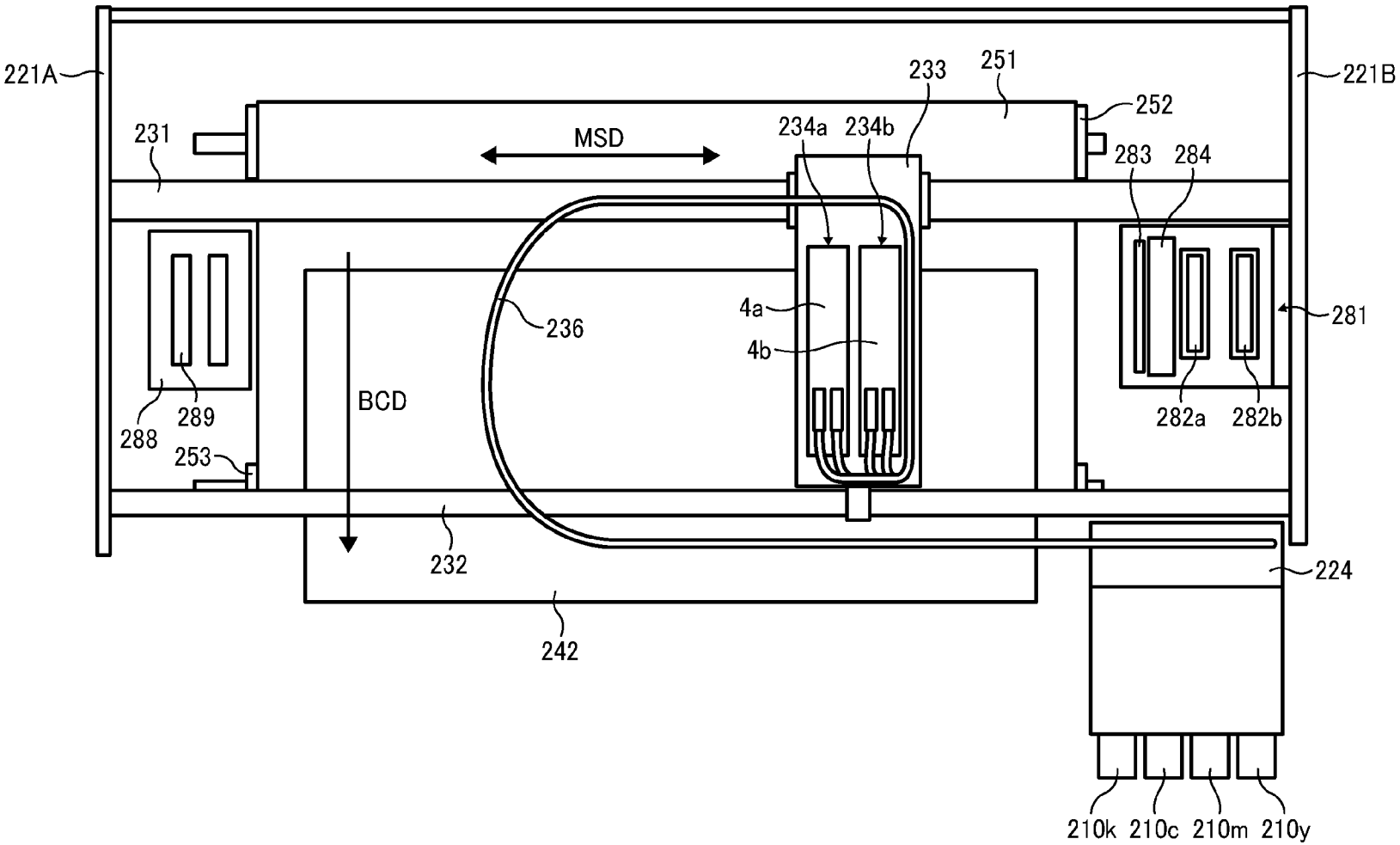
FIG. 24 is a partial plan view illustrating the mechanical section illustrated in FIG. 23.

In FIGS. 23 and 24, the image forming apparatus is illustrated as a serial-type image forming apparatus. In the image forming apparatus, both a main guide rod 231 and a sub guide rod 232 extend between side plates 201A and 201B to support a carriage 233 slidable in a main scan direction "MSD" indicated by a double arrow illustrated in FIG. 24. The carriage 233 moves for scanning by a main scan motor, not illustrated, via a timing belt.

A recording-head assembly 234 includes a plurality of liquid-ejection head units. Each liquid-ejection head unit is formed as a single unit with a liquid ejection head according to an exemplary embodiment of this disclosure to eject ink droplets of the corresponding color, e.g., yellow (Y), cyan (C), magenta (M), or black (K), an electric circuit board to transmit drive signals to the liquid-ejection head, and a tank that stores ink supplied to the liquid-ejection head. The recording-head assembly 234 is mounted on the carriage 233 so that a plurality of nozzle rows consisting of nozzles is arranged in a sub-scan direction perpendicular to the main scan direction so as to eject ink droplets downward.

The recording-head assembly 234 includes liquid-ejection head units 234*a* and 234*b* mounted on a base member. Each of the liquid-ejection head units 234*a* and 234*b* may include, e.g., two nozzle rows. For example, the recording-head unit 234*a* may eject black ink droplets from one nozzle row and cyan ink droplets from the other nozzle row, and the recording-head unit 234*b* may eject magenta ink droplets from one nozzle row and yellow ink droplets from the other nozzle row. In this exemplary embodiment, the recording-head assembly 234 includes two liquid-ejection heads that eject droplets of four colors. However, it is to be noted that the head configuration is not limited to such configuration and, for example, four nozzle rows may be formed in a single head to eject ink droplets of four different colors.

A supply unit 224 supplies (replenishes) respective color inks from corresponding ink cartridges 210 through corresponding supply tubes 236 to the tanks 235 of the recording-head assembly 234.

The image forming apparatus further includes a sheet feed section that feeds sheets 242 stacked on a sheet stack portion (platen) 241 of a sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to a portion below the recording head assembly 234, the image forming apparatus includes a first guide member 245 that guides the sheet 242, a counter roller 246, a conveyance guide member 247, a press member 248 including a front-end press roller 249, and a conveyance belt 251 that conveys the sheet 242 to a position facing the recording-head assembly 234 with the sheet 242 electrostatically attracted thereon.

The conveyance belt 251 is an endless belt that is looped between a conveyance roller 252 and a tension roller 253 so as to circulate in a belt conveyance direction "BCD", that is, the sub-scan direction. A charge roller 256 is provided to charge the surface of the conveyance belt 251. The charge roller 256 is disposed to contact the surface of the conveyance belt 251 and rotate depending on the circulation of the conveyance belt 251. By rotating the conveyance roller 252 by a sub-scan motor, not illustrated, via a timing roller, the conveyance belt 251 circulates in the belt conveyance direction "BCD" illustrated in FIG. 24.

The image forming apparatus further includes a sheet output section that outputs the sheet 242 on which an image has been formed by the recording heads 234. The sheet output section includes a separation claw 261 that separates the sheet 242 from the conveyance belt 251, a first output roller 262, a second output roller 263, and the sheet output tray 203 disposed below the first output roller 262.

A duplex unit 271 is removably mounted on a rear portion of the image forming apparatus. When the conveyance belt 251 rotates in reverse to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

In FIG. 24, a maintenance unit 281 is disposed at a non-print area on one end in the main-scan direction of the carriage 233. The maintenance unit 281 including a recovery device maintains and recovers nozzles of the recording head assembly 234. The maintenance unit 281 includes cap members 282*a* and 282*b* (hereinafter collectively referred to as "caps 282" unless distinguished) that cover the nozzle faces of the recording head assembly 234, a wiping blade 283 that is a blade member to wipe the nozzle faces of the recording head assembly 234, and a first droplet receiver 284 that receives ink droplets during maintenance ejection performed to discharge increased-viscosity ink.

In FIG. 24, a second droplet receiver 288 is disposed at a non-print area on the other end in the main-scan direction of the carriage 233. The second droplet receiver 288 receives ink droplets that are ejected to discharge increased-viscosity ink in recording (image forming) operation and so forth. The second droplet receiver 288 has openings 289 arranged in parallel with the rows of nozzles of the recording head assembly 234.

In the image forming apparatus having the above-described configuration, the sheet 242 is separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with a conveyance guide 237 and pressed with the front-end press roller 249 against the conveyance belt 251 so that the traveling direction of the sheet 242 is turned substantially 90 angle degrees.

At this time, plus outputs and minus outputs, i.e., supply positive and negative voltages are alternately applied to the charge roller 256 so that the conveyance belt 251 is charged with an alternating voltage pattern, that is, an alternating band pattern of positively-charged areas and negatively-charged areas in the sub-scanning direction, i.e., the belt circulation direction. When the sheet 242 is fed onto the conveyance belt 251 alternately charged with positive and negative charges, the sheet 242 is electrostatically attracted on the conveyance belt 251 and conveyed in the sub-scanning direction by circulation of the conveyance belt 251.

By driving the recording head assembly 234 in response to image signals while moving the carriage 233, ink droplets are ejected on the sheet 242 stopped below the recording head assembly 234 to form one band of a desired image. Then, the sheet 242 is fed by a certain amount to prepare for recording another band of the image. Receiving a signal indicating that the image has been recorded or the rear end of the sheet 242 has arrived at the recording area, the recording head assembly 234 finishes the recording operation and outputs the sheet 242 to the sheet output tray 203.

As described above, the image forming apparatus includes the recording head(s) according to an exemplary embodiment of this disclosure, and thus has an increased reliability.

Next, an image forming apparatus according to another exemplary embodiment of this disclosure that includes the liquid ejection head according to an exemplary embodiment of this disclosure is described with reference to FIG. 25.

Figure 25:
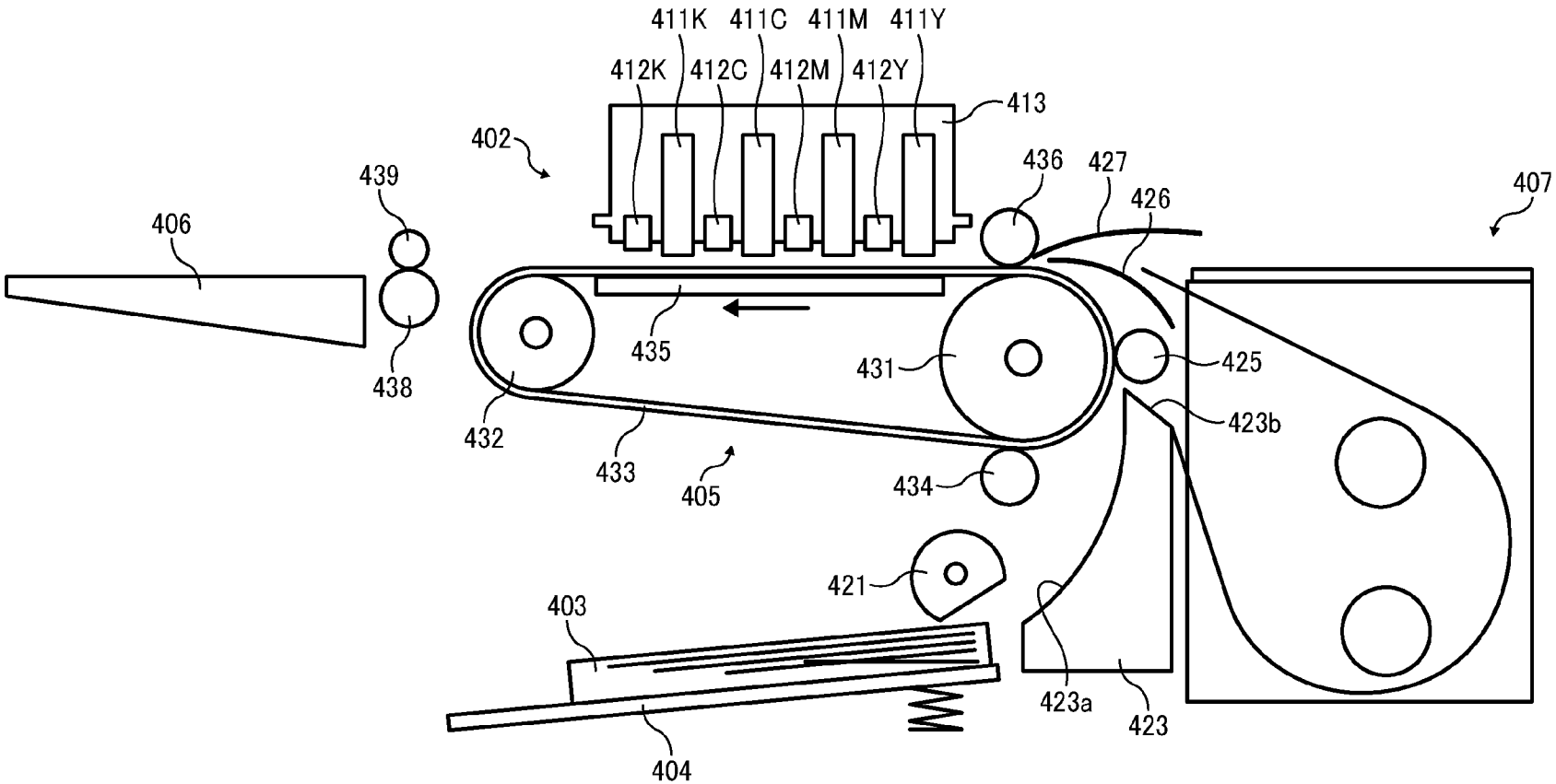
FIG. 25 is a schematic view illustrating a mechanical section of an image forming apparatus according to another exemplary embodiment.

FIG. 25 is a schematic view illustrating a mechanical section of the image forming apparatus.

In FIG. 25, the image forming apparatus is illustrated as a line-head-type image forming apparatus and includes an image forming section 402, a sheet feed tray 404, a conveyance unit 405, and a sheet output tray 406. A plurality of recording sheets 403 is stacked on the sheet feed tray 404 at a lower portion of the image forming apparatus. When the recording sheet 403 is fed from the sheet feed tray 404, the image forming section 402 records an image on the recording sheet 403 conveyed by the conveyance unit 405, and then the conveyance unit 405 outputs the recording sheet 403 to the sheet output tray 406 mounted on a lateral side of the image forming apparatus.

A duplex unit 407 is removably mountable to the image forming apparatus. In double-face printing, when printing on one face of the recording sheet 403 is finished, the recording sheet 403 is turned upside down by the conveyance unit 405 and sent into the duplex unit 407. Accordingly, the duplex unit 407 feeds the other face of the recording sheet 403 as a printable face to the conveyance unit 405 again. The image forming section 402 records an image on the other face of the recording sheet 403 and outputs the sheet 403 to the sheet output tray 406.

The image forming section 402 includes recording-head units 411Y, 411M, 411C, and 411K (hereinafter, referred to as "recording head units 411" unless colors are distinguished). Each of the recording-head units 411Y, 411M, 411C, and 411K is formed as a single unit with a line-head-type liquid ejection head according to an exemplary embodiment of this disclosure and a sub tank that stores ink supplied to the corresponding liquid ejection head. Each recording head unit 411 is mounted on a head holder 413 so that the nozzle face having nozzles through which ink droplets are ejected is oriented downward.

Figure 26:
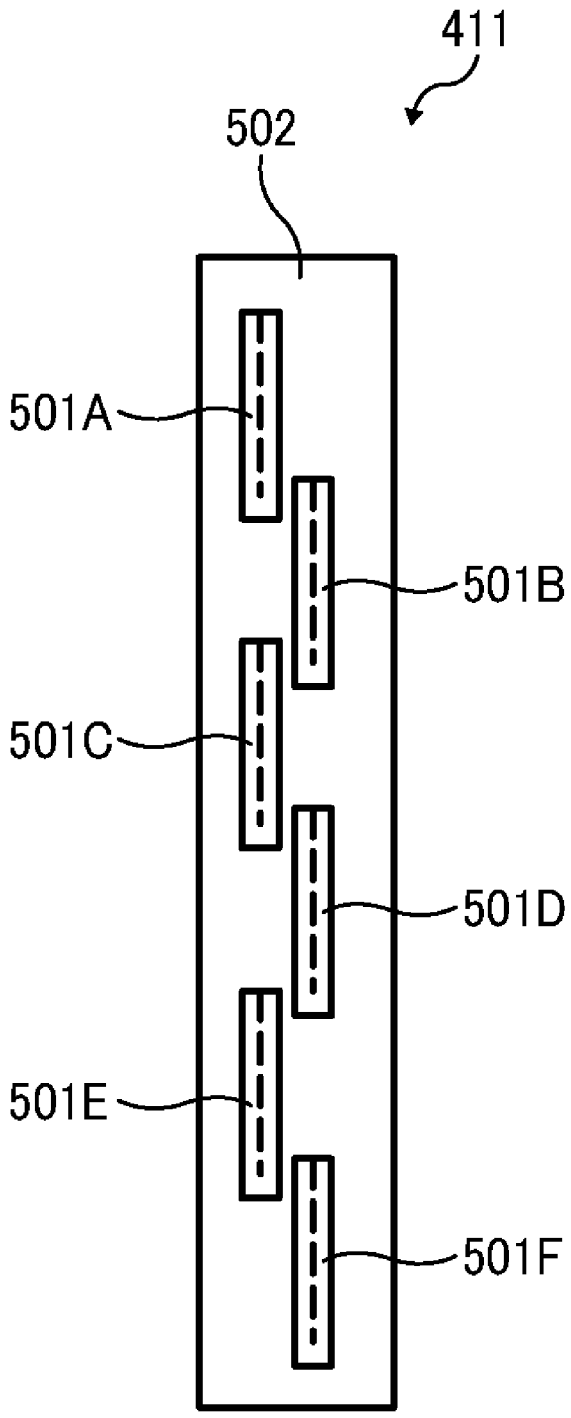
FIG. 26 is a schematic view illustrating a configuration of a recording head used in the image forming apparatuses.

In this exemplary embodiment, as illustrated in FIG. 26, each of the recording head units 411 includes a plurality of (in this example, six) liquid ejection heads 501A to 501F formed as a single unit with a sub tank. The plurality of liquid ejection heads 501A to 501F are arranged in a predetermined pattern on a base member 502. However, it is to be noted that the number and arrangement of heads are not limited to those illustrated in FIG. 26 and, for example, one full-line-type liquid ejection head may be employed.

The image forming apparatus includes maintenance units 412Y, 412M, 412C, and 412K (hereinafter, referred to as "maintenance units 412" unless colors are distinguished) that are provided corresponding to the recording head units 411Y, 411M, 411C, and 411K to maintain and recover the ejection performance of the liquid ejection heads. In maintenance operations such as purging and wiping, the recording head units 411 and the corresponding maintenance units 412 are relatively shifted so that the nozzle faces of the recording head units 411 oppose capping members and/or other members of the corresponding maintenance units 412.

The recording sheets 403 stacked on the sheet feed tray 404 are separated with a sheet feed roller 421 and a separation pad, not illustrated, and fed sheet by sheet toward a conveyance guide member 423. The recording sheet 403 is sent between a registration roller 425 and a conveyance belt 433 along a guide face 423*a* of the conveyance guide member 423, and at a proper timing, sent onto the conveyance belt 433 of the conveyance unit 405 along a second guide member 426.

The conveyance guide member 423 also has a second guide face 423*b* that guides the recording sheet 403 sent from the duplex unit 407. The image forming apparatus includes a third guide member 427 that guides the recording sheet 403, which is returned from the conveyance unit 405 in duplex printing, toward the duplex unit 407.

The conveyance unit 405 includes the conveyance belt 433 that is an endless belt looped between a conveyance roller 431 and a driven roller 432, a charge roller 434 that charges the conveyance belt 433, a platen member 435 that maintains flatness of a portion of the conveyance belt 433 facing the image forming section 402, a press roller 436 that presses the recording sheet 403 sent from the conveyance belt 433 against the conveyance roller 431, and a cleaning roller formed with a porous member to remove residual recording liquid (ink) adhered on the conveyance belt 433. The conveyance unit may attract the recording sheet 403 onto the conveyance belt 433 by, for example, air suction.

At the downstream side of the conveyance unit 405 is disposed a sheet output roller 438 and a spur 439 to send the recording sheet 403, on which an image has been recorded, to the sheet output tray 406.

In the image forming apparatus of such a configuration, the conveyance belt 433 is circulated in a direction indicated by an arrow "D" in FIG. 25 and charged by contacting the charge roller 434 to which a high-potential voltage is supplied. When the recording sheet 403 is conveyed onto the conveyance belt 433 charged, the recording sheet 403 is attracted on the conveyance belt 433. Thus, such strong attachment of the recording sheet 403 against the conveyance belt 433 prevents curling and surface irregularity of the recording sheet 403, thus forming a highly flattened face.

When the recording sheet 403 is moved by circulating the conveyance belt 433, the recording head units 411 eject droplets of recording liquid to form an image on the recording sheet 403. After image recording, the recording sheet 403 is outputted by the output roller 438 to the sheet output tray 406.

As described above, the image forming apparatus includes the liquid ejection head according to an exemplary embodiment of this disclosure, thus improving the reliability.

In the exemplary embodiment described above, the image forming apparatus is configured as the printer. However, it is to be noted that the image forming apparatus is not limited to the printer and may be, for example, a facsimile, a copier, or a multi-functional peripheral having several of the foregoing capabilities. Further, the above-described embodiments may be implemented in the image forming apparatus that employs, e.g., liquid other than ink in narrow definition, or fixing processing agent.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. A liquid ejection head comprising:

a plurality of nozzles from which droplets of liquid are ejected;

a plurality of separate chambers communicated with the plurality of nozzles;

a common chamber from which liquid is supplied to the separate chambers;

a plurality of inlet portions communicated with the corresponding separate chambers, through which liquid is supplied from the common chamber to the plurality of separate chambers;

a filter unit disposed between the plurality of inlet portions and the common chamber to filter liquid in an area across the plurality of separate chambers in a first direction in which the plurality of nozzles is arrayed; and a plurality of ribs disposed in the filter unit at intervals corresponding in size to at least two of the separate chambers in the first direction to partition the filter unit, the plurality of inlet portions communicated in the first direction with each other in at least one portion of each of the plurality of inlet portions facing the filter unit.

2. The liquid ejection head according to claim 1, further comprising a diaphragm member forming part of a wall face of each of the separate chambers, wherein the filter unit is formed in the diaphragm member.

3. The liquid ejection head according to claim 2, further comprising a damper chamber disposed so as to sandwich the diaphragm member between the damper chamber and the common chamber, an open area of the common chamber decreasing in size away from the diaphragm member.

4. The liquid ejection head according to claim 1, wherein partition walls of the inlet portions corresponding to positions of the ribs are not communicated with each other.

5. The liquid ejection head according to claim 1, wherein both the plurality of separate chambers and the plurality of inlet portions are formed as a single integrated member.

6. The liquid ejection head according to claim 1, wherein the ribs are formed on both upstream and downstream sides of the filter unit in a second direction in which liquid passes through the filter unit.

7. The liquid ejection head according to claim 6, wherein the ribs formed downstream in the second direction are disposed at positions corresponding to positions of the partition walls of the inlet portions.

8. The liquid ejection head according to claim 6, wherein the ribs formed upstream in the second direction and the corresponding ribs formed downstream in the second direction are substantially aligned in the second direction.

9. The liquid ejection head according to claim 6, wherein the ribs formed upstream in the second direction are disposed midway between the ribs formed downstream in the second direction.

10. The liquid ejection head according to claim 6, wherein at least some of the ribs formed upstream in the second direction and the ribs formed downstream in the second direction are disposed at any intervals corresponding in size to four to sixteen partition walls of the separate chambers.

11. The liquid ejection head according to claim 1, further comprising a heater mounted on a side face of the filter unit.

12. The liquid ejection head according to claim 1, wherein the liquid is ultraviolet curing liquid.

13. A liquid ejection device comprising a liquid ejection head, the liquid ejection head comprising:

a plurality of nozzles from which droplets of liquid are ejected;

a plurality of separate chambers communicated with the plurality of nozzles;

a common chamber from which liquid is supplied to the separate chambers;

a plurality of inlet portions communicated with the corresponding separate chambers, through which liquid is supplied from the common chamber to the plurality of separate chambers;

a filter unit disposed between the plurality of inlet portions and the common chamber to filter liquid in an area across the plurality of separate chambers in a first direction in which the plurality of nozzles is arrayed; and a plurality of ribs disposed in the filter unit at intervals corresponding in size to at least two of the separate chambers in the first direction to partition the filter unit, the plurality of inlet portions communicated in the first direction with each other in at least one portion of each of the plurality of inlet portions facing the filter unit.

14. An image forming apparatus comprising a liquid ejection head, the liquid ejection head comprising:

a plurality of nozzles from which droplets of liquid are ejected;

a plurality of separate chambers communicated with the plurality of nozzles;

a common chamber from which liquid is supplied to the separate chambers;

a plurality of inlet portions communicated with the corresponding separate chambers, through which liquid is supplied from the common chamber to the plurality of separate chambers;

a filter unit disposed between the plurality of inlet portions and the common chamber to filter liquid in an area across the plurality of separate chambers in a first direction in which the plurality of nozzles is arrayed; and a plurality of ribs disposed in the filter unit at intervals corresponding in size to two at least of the separate chambers in the first direction to partition the filter unit, the plurality of inlet portions communicated in the first direction with each other in at least one portion of each of the plurality of inlet portions facing the filter unit.

* * * * *